US011602935B2

(12) United States Patent
Kise

(10) Patent No.: US 11,602,935 B2
(45) Date of Patent: Mar. 14, 2023

(54) THERMAL PRINT HEAD, MANUFACTURING METHOD OF THERMAL PRINT HEAD, AND THERMAL PRINTER

(71) Applicant: ROHM CO., LTD., Kyoto (JP)

(72) Inventor: Nobukazu Kise, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 17/404,820

(22) Filed: Aug. 17, 2021

(65) Prior Publication Data

US 2022/0063292 A1 Mar. 3, 2022

(30) Foreign Application Priority Data

Aug. 31, 2020 (JP) ..... 2020-145263

(51) Int. Cl.
*B41J 2/335* (2006.01)
*B41J 2/32* (2006.01)

(52) U.S. Cl.
CPC ..... *B41J 2/33515* (2013.01); *B41J 2/32* (2013.01); *B41J 2/3353* (2013.01); *B41J 2/3359* (2013.01); *B41J 2/33505* (2013.01); *B41J 2/33595* (2013.01)

(58) Field of Classification Search
CPC ..... B41J 2/33515; B41J 2/32; B41J 2/33505; B41J 2/3353; B41J 2/3359; B41J 2/33595
See application file for complete search history.

(56) References Cited

U.S. PATENT DOCUMENTS

2019/0263141 A1* 8/2019 Kimura ..... B41J 2/3353

FOREIGN PATENT DOCUMENTS

CN 101412323 A * 4/2009 ..... B41J 2/335
JP 2014193563 A * 10/2014 ..... B41J 2/335
JP 2019166824 A 10/2019

* cited by examiner

*Primary Examiner* — Yaovi M Ameh
(74) *Attorney, Agent, or Firm* — Hamre, Schumann, Mueller & Larson, P.C.

(57) ABSTRACT

The present disclosure provides a thermal print head and a method manufacturing the thermal print head, and a thermal printer including the thermal print head. The thermal print head includes: a substrate having a protruding surface; a resistance layer including multiple heating portions and a portion formed on the protruding surface; and a wiring layer conductive to the multiple heating portions. The thermal print head further includes a glaze layer having a pair of end edges arranged apart from each other in y direction and formed in contact with a top surface of the protruding surface. The multiple heating portions are formed on the glaze layer. When observed in z direction, each of the pair of end edges includes a receding section located closer to an inner side of the top surface than a junction of the top surface, and a pair of inclined surfaces of the protruding surface.

15 Claims, 17 Drawing Sheets

THERMAL PRINT HEAD, MANUFACTURING METHOD OF THERMAL PRINT HEAD, AND THERMAL PRINTER

BACKGROUND OF THE INVENTION

Field of the Invention

The disclosure relates to a thermal print head and a manufacturing method thereof, and a thermal printer including the thermal print head.

Description of the Prior Art

Patent publication 1 discloses a thermal print head in which silicon is used in a substrate material thereof. In the thermal print head disclosed by the publication, the substrate has a main surface, and a protrusion extending in a main scan direction and protruding from the main surface. As shown in FIG. 6 of the publication, multiple heating portions are arranged in the main scan direction on the protrusion. According to the configuration above, a printing medium is enabled to reliably come into contact with the protrusion arranged with the multiple heating portions, thereby achieving enhanced printing quality as anticipated. On the other hand, there is a need for a solution for improving printing energy efficiency in industry.

PRIOR ART DOCUMENT

Patent Publication

[Patent publication 1] Japan Patent Publication No. 2019-166824

SUMMARY

Problems to be Solved by the Invention

In view of the situations above, it is a task of the disclosure to provide a thermal print head and a manufacturing method thereof, and a thermal printer having the thermal print head, in seek of improving printing energy efficiency.

Technical Means for Solving the Problem

A thermal print head provided according to a first embodiment of the disclosure is characterized in including: a substrate, having a main surface facing a thickness direction, and a protruding surface connected to the main surface and protruding toward one side which the main surface faces in the thickness direction; a resistance layer, including a plurality of heating portions arranged in a main scan direction, and formed on the main surface and the protruding surface; and a wiring layer, formed in contact with the resistance layer, and conductive to the plurality of heating portions. The protruding surface includes a top surface parallel to the main surface, and a pair of inclined surfaces connected to the top surface and the main surface and arranged apart from each other in a secondary scan direction. The thermal print head further includes a glaze layer which has a pair of end edges arranged apart from each other in the secondary scan direction and formed in contact with the top surface, and the plurality of heating portions are formed on the glaze layer. When observed in the thickness direction, each of the pair of end edges includes a receding section which is located closer to an inner side of the top surface than a junction of the top surface and the pair of inclined surfaces.

A thermal print head provided according to a second embodiment of the disclosure is characterized in including steps of: forming a main surface facing a thickness direction, and a protruding surface connected to the main surface and protruding toward one side which the main surface faces in the thickness direction on a base material; forming a resistance layer on the main surface and the protruding surface, the resistance layer including a plurality of heating portions arranged in a main scan direction; and forming a wiring layer in contact with the resistance layer and conductive to the plurality of heating portions; wherein the protruding surface includes a top surface parallel to the main surface, and a pair of inclined surfaces connected to the top surface and the main surface and arranged apart from each other in a secondary scan direction. The manufacturing method further includes a step of forming a glaze layer in contact with the top surface between the step of forming the main surface and the protruding surface and the step of forming the resistance layer. In the step of forming the glaze layer, after providing a glaze material in a fluid to the top surface, the glaze material is sintered to form the glaze layer.

A thermal printer provided according to a third embodiment of the disclosure includes: the thermal print head provided according to the first embodiment of the disclosure; and a platen, arranged oppositely to the plurality of heating portions.

Effects of the Invention

According to the thermal print head and the manufacturing method thereof of the disclosure, improved printing energy efficiency can be achieved.

Other features and advantages of the disclosure will become more readily apparent with the detailed description given with the accompanying drawings below.

DETAILED DESCRIPTION OF THE EMBODIMENTS

Embodiments for implementing the disclosure are described according to the accompanying drawings.

First Embodiment

Figure 2:
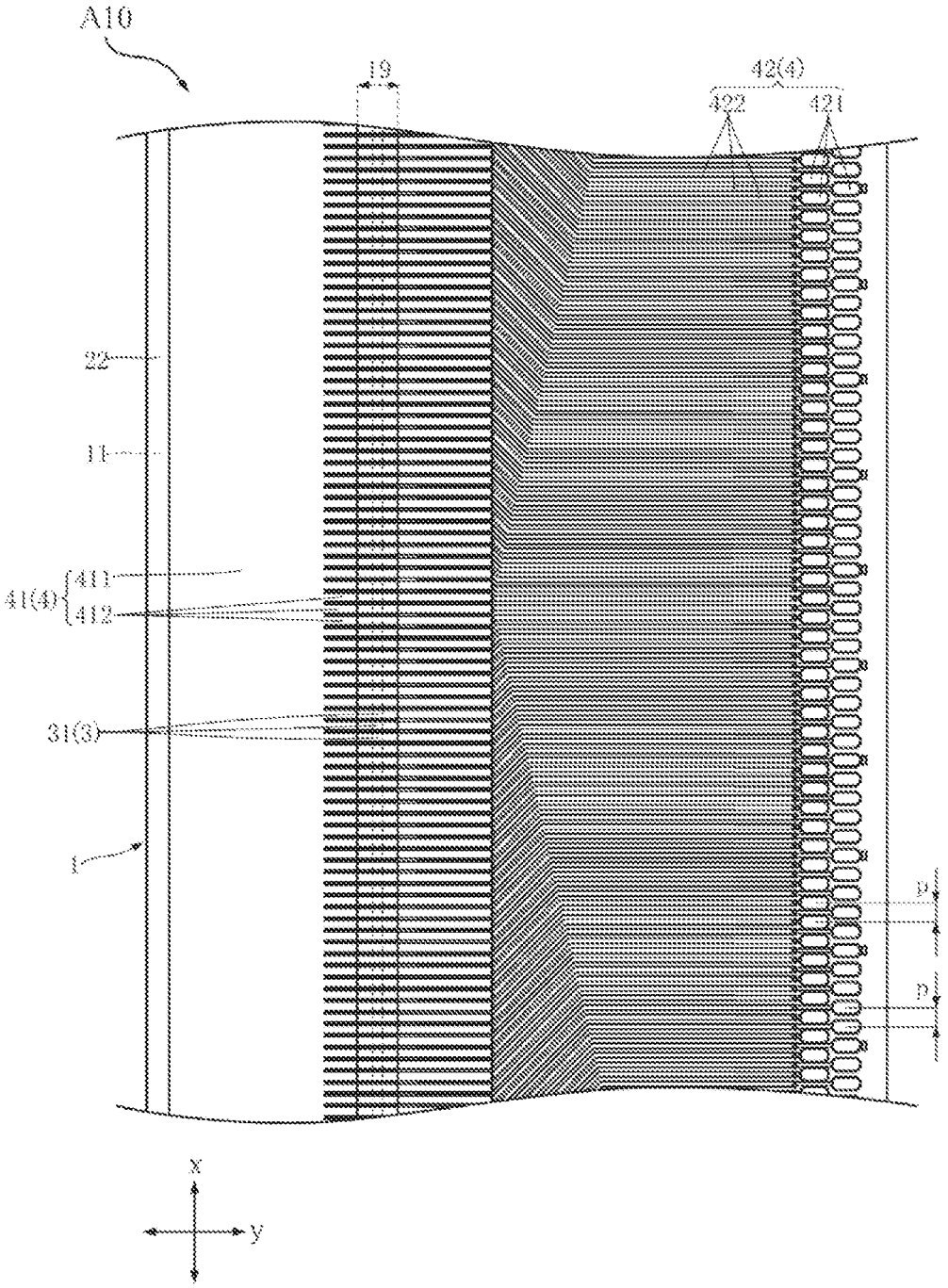
FIG. 2 is a top view of a main part of the thermal print head in FIG. 1.
Figure 3:
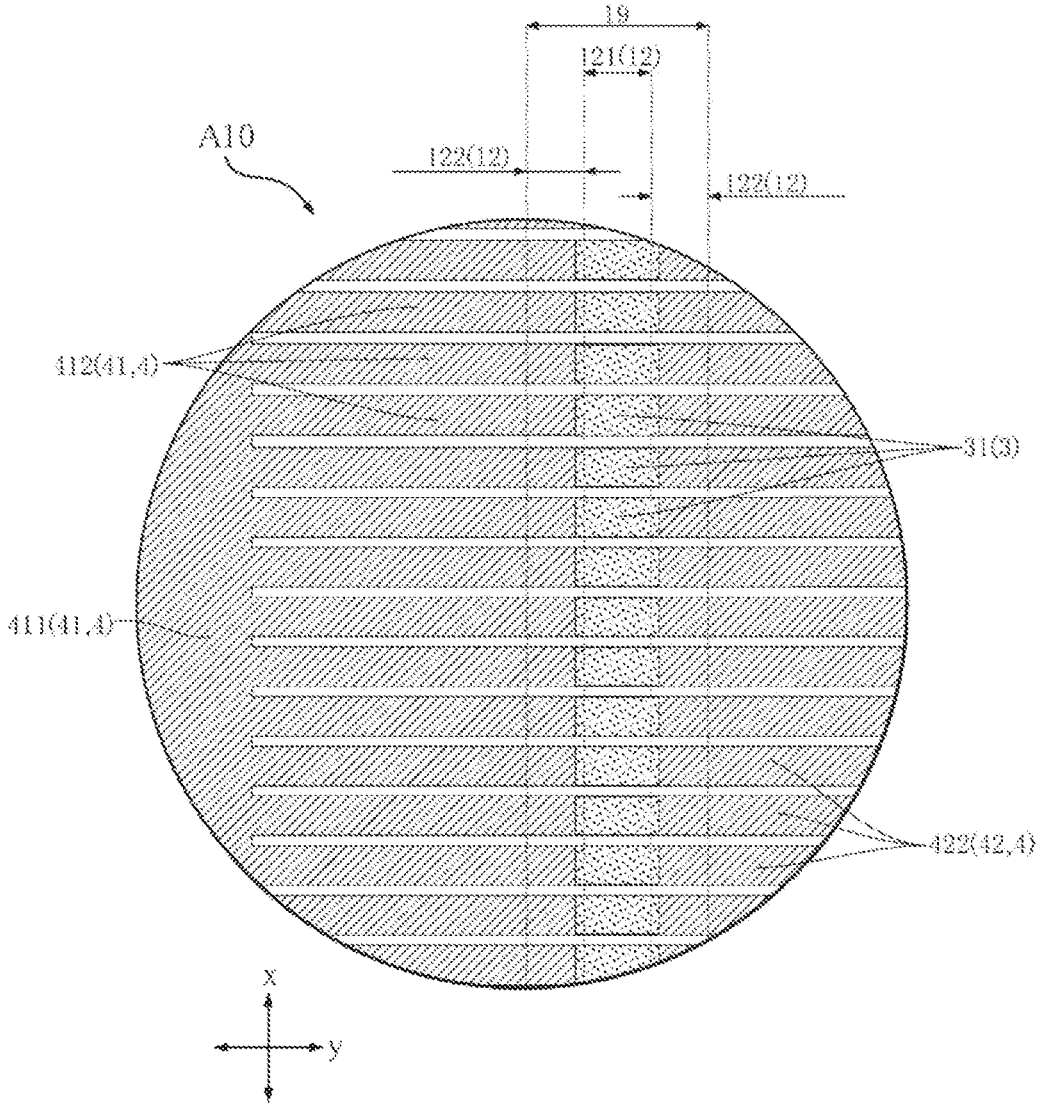
FIG. 3 is a partial enlarged view of FIG. 2.
Figure 7:
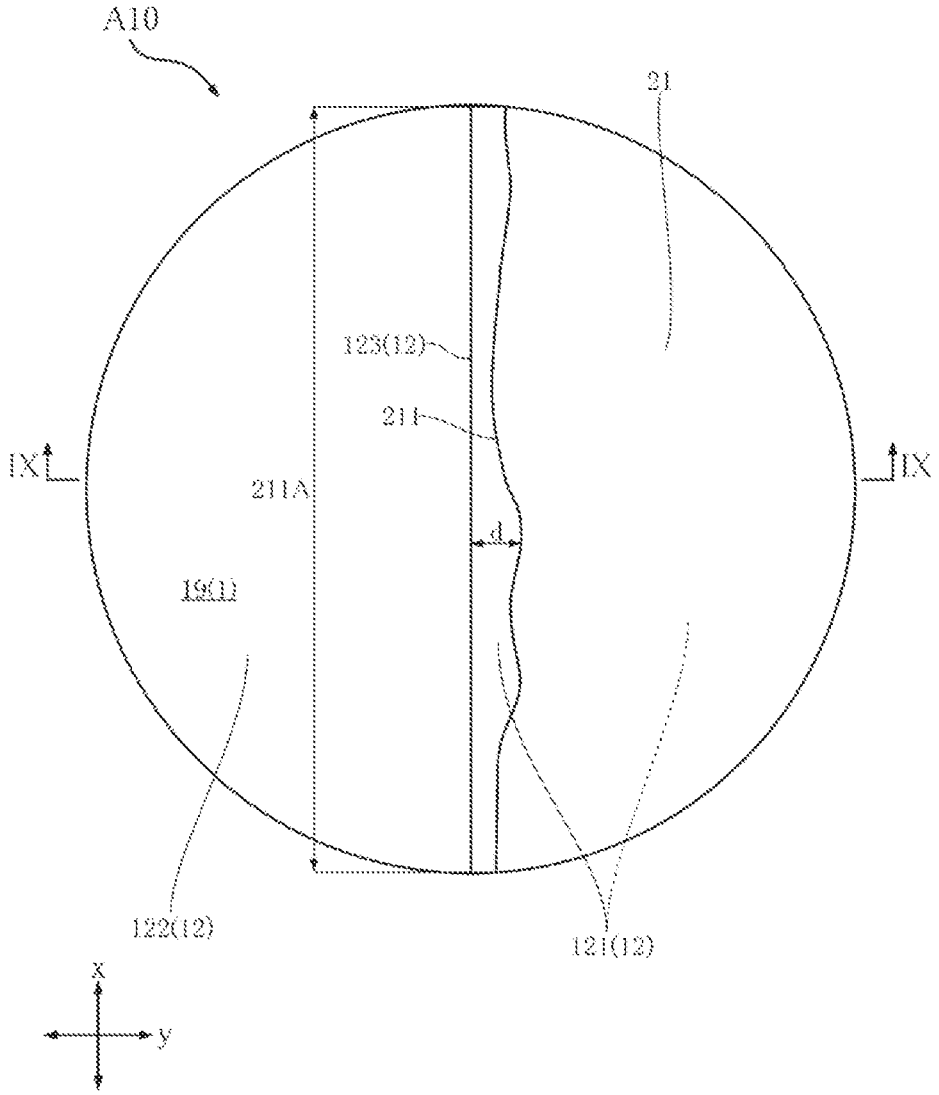
FIG. 7 is a partial enlarged view of FIG. 3, and observed through an insulation layer, a resistance layer and a wiring layer.
Figure 8:
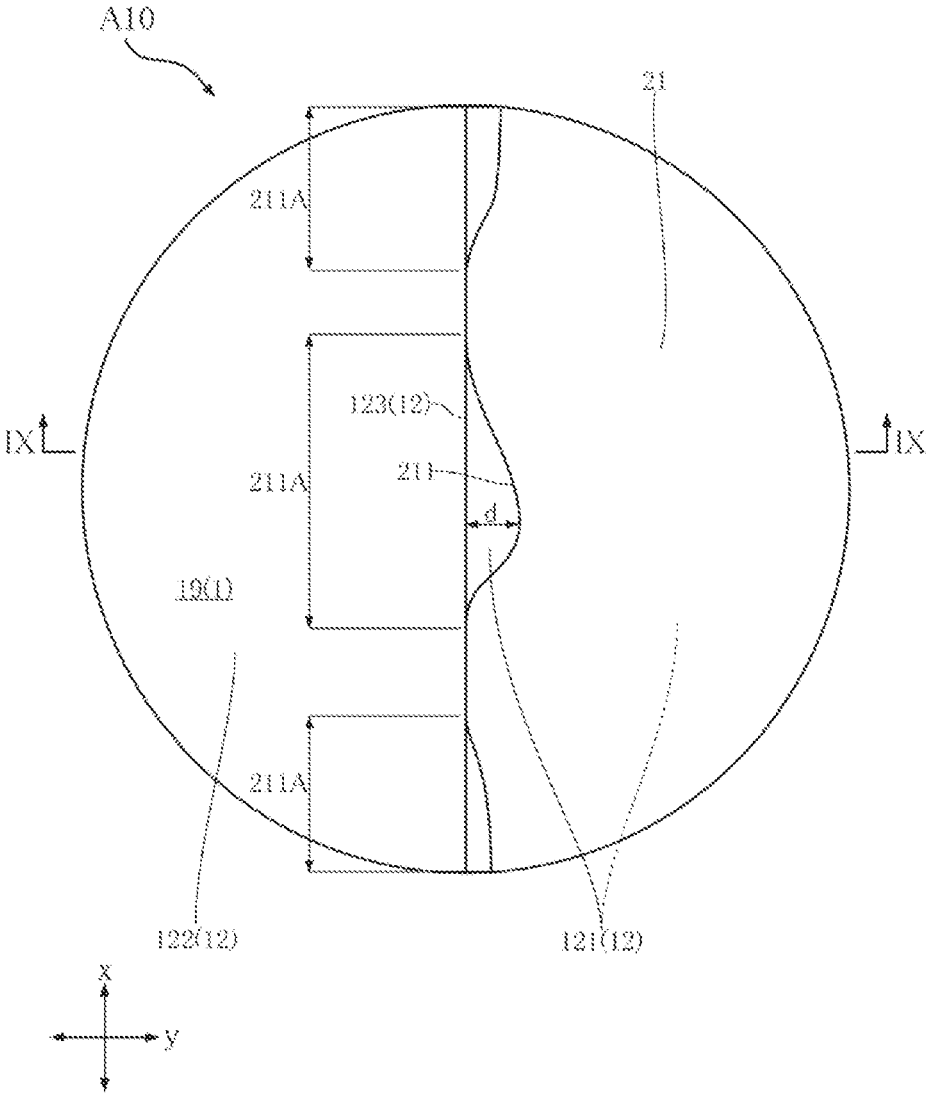
FIG. 8 is a partial enlarged view of FIG. 3, and observed through an insulation layer, a resistance layer and a wiring layer.

On the basis of FIG. 1 to FIG. 10, a thermal print head A10 according to a first embodiment of the disclosure is described below. The thermal print head A10 forms the main part of a thermal printer B10 to be described hereinafter. The thermal print head A10 is formed by the main part and a secondary part. The main part of the thermal print head A10 includes a substrate 1, a glaze layer 21, an insulation layer 22, a resistance layer 3, a wiring layer 4 and a protection layer 5. The secondary part of the thermal print head A10 includes a wiring substrate 71, a heat dissipation plate 72, multiple driving elements 73, multiple first conducting wires 74, multiple second conducting wires 75, a sealing resin 76 and a connector 77. Further, in FIG. 1, for better understanding, observation is made through the protection layer 5, and the multiple first conducting wires 74, the multiple second conducting wires 75 and the sealing resin 76 are omitted. In FIG. 2 and FIG. 3, for better understanding, observation is made through the protection layer 5. In FIG. 7 and FIG. 8, for better understanding, observation is made through the insulation layer 22, the resistance layer 3 and the wiring layer 4 relative to FIG. 3. The position and size of the cross section of FIG. 10 are the same as the position and size of the cross section of FIG. 6.

Further, for better illustration, a main scan direction of the thermal print head A10 is referred to as the "x direction", a secondary scan direction of the thermal print head A10 is referred to as the "y direction", and the thickness direction of the substrate 1 is referred to as the "z direction". The z direction is perpendicular to both the x direction and the y direction. In the description below, "observed in the z direction" means "observed in the thickness direction".

Figure 4:
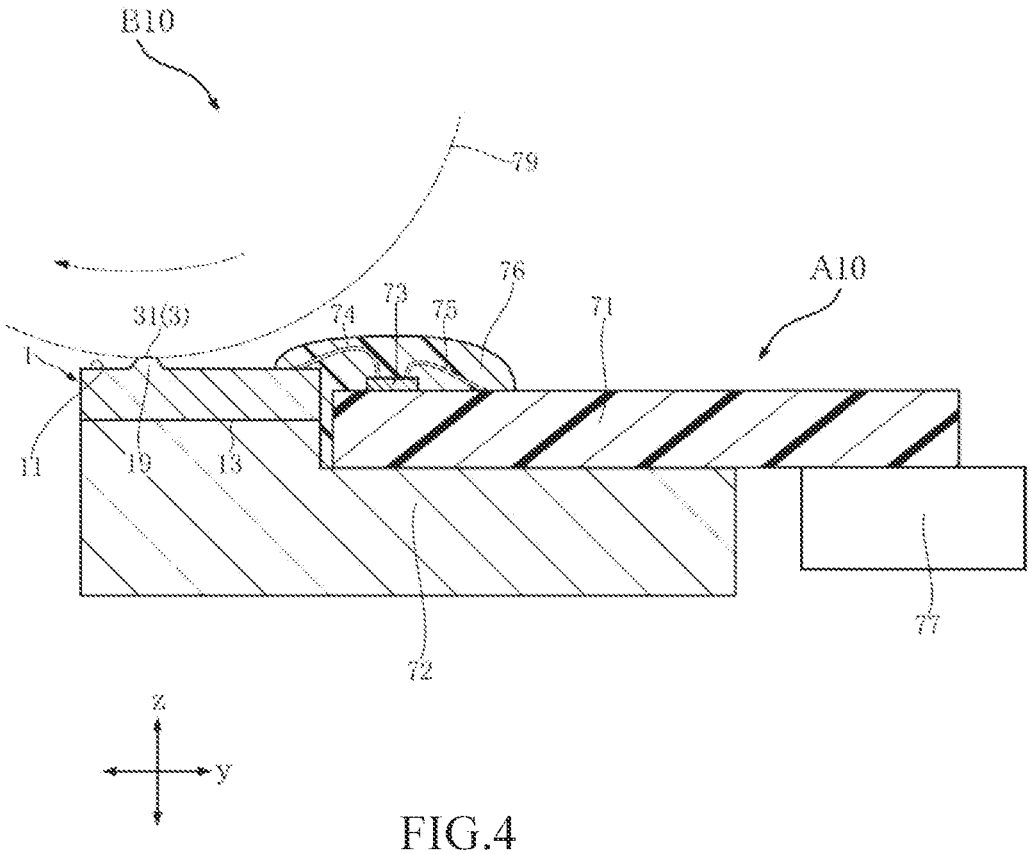
FIG. 4 is a cross-sectional diagram of FIG. 1 taken along the line IV-IV.

In the thermal print head A10, as shown in FIG. 4, the substrate 1 forming the main part of the thermal print head A10 is joined to the heat dissipation plate 72. Further, the wiring substrate 71 is located next to the substrate 1 in the y direction. Similar to the substrate 1, the wiring substrate 71 is fixed on the heat dissipation plate 72. Multiple heating portions 31 are formed on the substrate 1 (with details to be described below), and these heating portions 31 form a part of the resistance layer 3 and are arranged in the x direction. The multiple heating portions 31 selectively generate heat through multiple driving elements 73 mounted on the wiring substrate 71. The multiple driving elements 73 perform driving according to a printing signal sent from the exterior through the connector 77.

Further, as shown in FIG. 4, the thermal printer B10 of the disclosure includes the thermal print head A10 and a pressure roller 79. In the thermal printer B10, the pressure roller 79 is a roller mechanism that transports a recording medium such as thermal paper. The pressure roller 79 presses the recording medium against the multiple heating portions 31, and the multiple heating portions 31 accordingly perform printing on the recording medium. In the thermal printer B10, a non-roller mechanism may be used as a substitution for the pressure roller 79. The mechanism has a flat surface. Moreover, the flat surface has a curve surface with a smaller curvature. In thermal printer B10, a roller mechanism including the pressure roller 79 and related mechanisms are collectively referred to as a "platen". For better illustration, a side of a supply source (the right of FIG. 4) of the recording medium in FIG. 4 is referred to an "upstream side", and a side of a discharge destination (the left of FIG. 4) of the recording medium in FIG. 4 is referred to a "downstream side".

Figure 1:
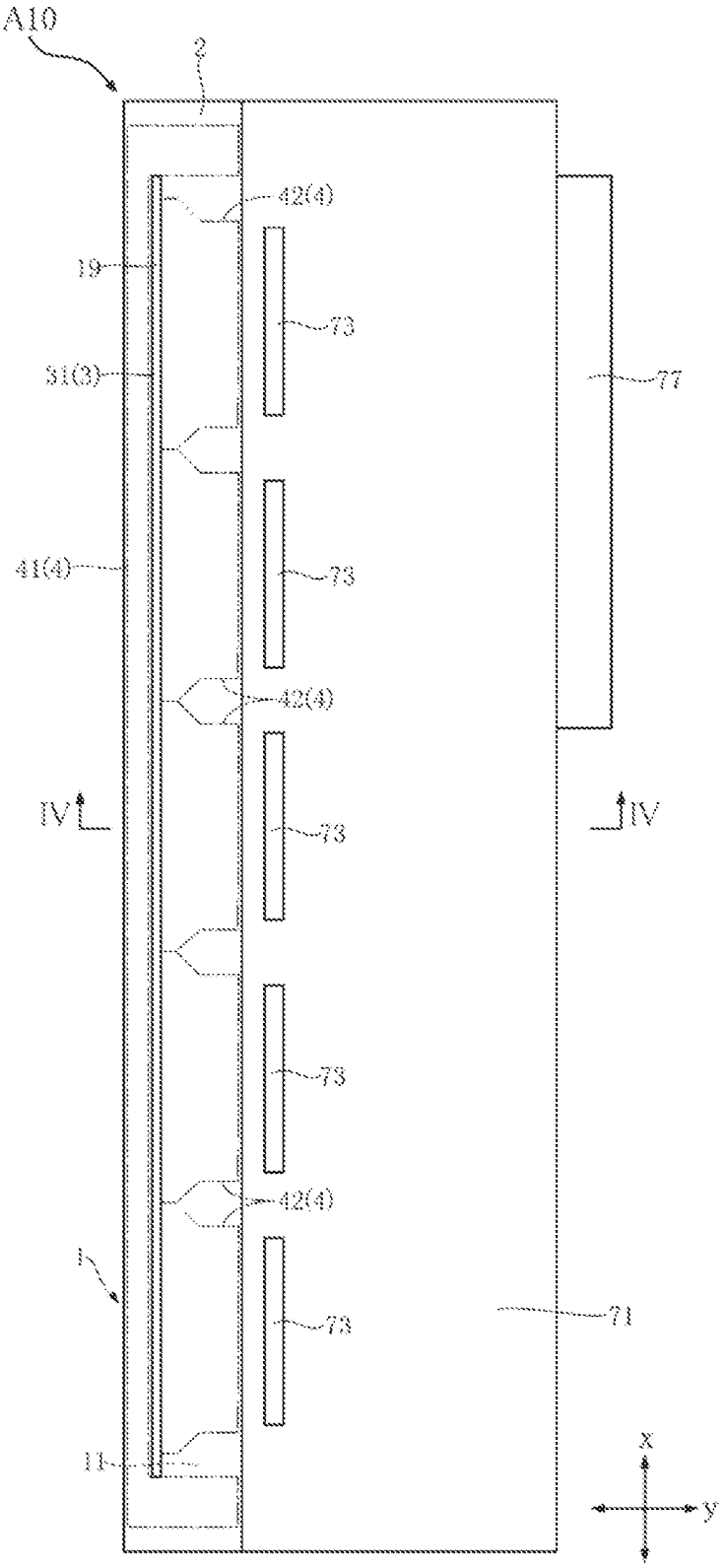
FIG. 1 is a top view of a thermal print head according to a first embodiment of the disclosure and observed through a protection layer.

As shown in FIG. 1, the substrate 1 is a strip extending in the x direction when observed in the z direction. The substrate 1 includes a semiconductor material. The semiconductor material includes a monocrystalline material including silicon (Si).

Figure 5:
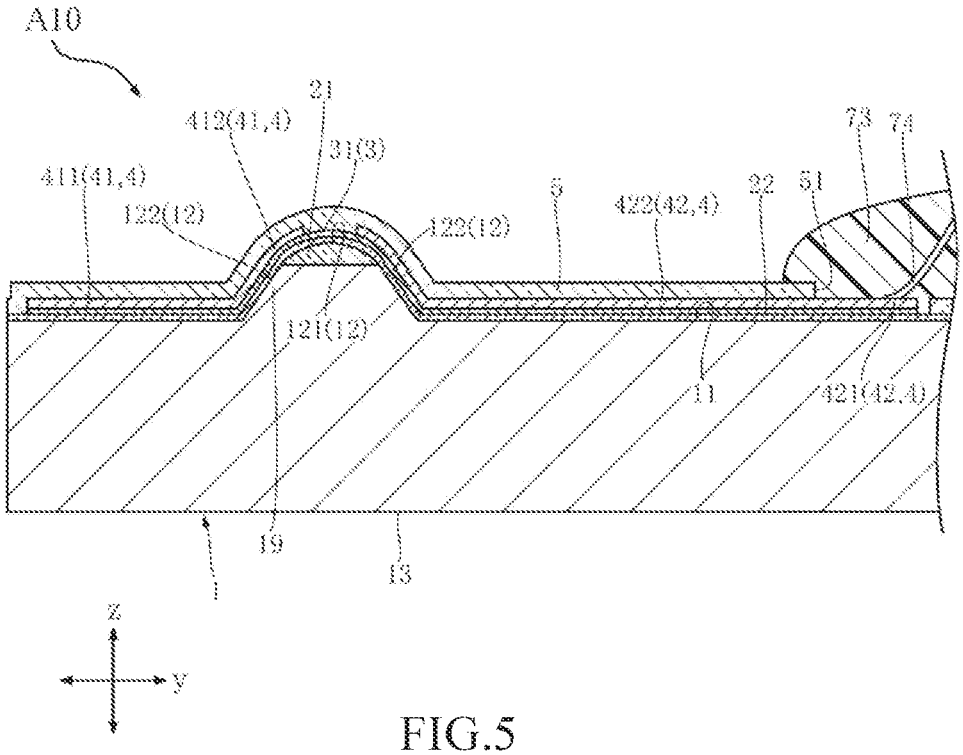
FIG. 5 is a cross-sectional diagram of the main part of the thermal print head in FIG. 1.

As shown in FIG. 5, the substrate 1 has a main surface 11 and a back surface 13. The surface orientations of the main surface 11 and the back surface 13 of the crystalline structure based on the substrate 1 are both (100) surfaces. The main surface 11 and the back surface 13 face opposite sides from each other in the z direction. As shown in FIG. 4, in the thermal print head A10, the main surface 11 is opposite to the pressure roller 79, and the back surface 13 is opposite to the wiring substrate 71. The substrate 1 further includes a protruding surface 12. The protruding surface 12 is connected to the main surface 11, and protrudes toward one side which the main surface 11 faces in the z direction. The protruding surface 12 extends along the x direction.

Figure 6:
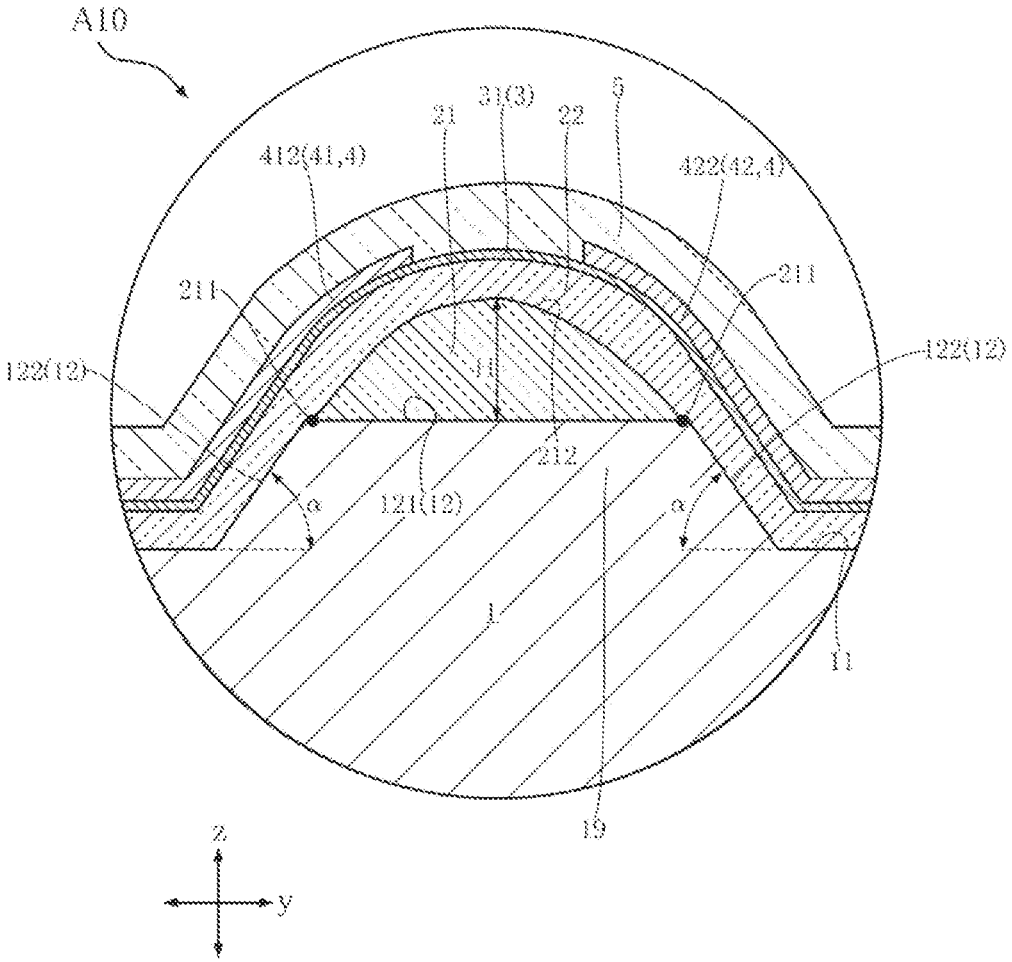
FIG. 6 is a partial enlarged view of FIG. 5.

As shown in FIG. 6, the protruding surface 12 has a top surface 121 and a pair of inclined surfaces 122. The top surface 121 is arranged as separate from the main surface 11 in the z direction, and is parallel to the main surface 11. The pair of inclined surfaces 122 are arranged apart from each other in the y direction. The pair of inclined surfaces 122 are connected to the top surface 121 and the main surface 11. The pair of inclined surfaces 122 are inclined relative to the main surface 11 in a manner of approaching each other from the main surface 11 to the top surface 121. Respective inclined angles α of the pair of inclined surfaces 122 relative to the main surface 11 are equal.

As shown in FIG. 6, a protrusion 19 is formed on the substrate 1. The protrusion 19 protrudes in the z direction from the main surface 11 and extends in the x direction. The protrusion surface 12 forms the surface of the protrusion 19. Thus, the structure of the protruding surface 12 is based on the shape of the protrusion 19.

As shown in FIG. 5, a glaze layer 21 is formed in contact with the top surface 121 of the protruding surface 12 of the substrate 1. The glaze layer 21 includes, for example, amorphous glass. Thus, the glaze layer 21 includes a glass-containing material. The linear expansion coefficient of the glaze layer 21 is equal to the linear expansion coefficient of the substrate 1. As shown in FIG. 6, the glaze layer 21 protrudes toward one side which the top surface 121 faces in the z direction. The glaze layer 21 is not connected to the pair of inclined surfaces 122 of the protruding surface 12. A size H of the glaze layer 21 in the z direction is the greatest in a center of the glaze layer 21 in the y direction.

As shown in FIG. 6, the glaze layer 21 has a pair of end edges 211. The pair of end edges 211 are connected to the top surface 121 of the protruding surface 12 of the substrate 1, and are arranged apart from each other in the y direction. As shown in FIG. 7 and FIG. 8, when observed in the z direction, each end edge 211 includes a receding section 211A. The receding section 211A is located closer to an inner side of the top surface 121 than a junction 123 of the top surface 121 and the pair of inclined surfaces 122 of the protruding surface 12. FIG. 7 shows a situation in which an entire interval of each end edge 211 consecutively forms the receding section 211A. FIG. 8 shows a situation in which an entire interval or a part of the interval of each end edge 211 inconsecutively forms the receding section 211A. The receding section 211A includes the two situations in FIG. 7 and FIG. 8. A distance d (referring to FIG. 7 to FIG. 9) from any between the junctions 123 of the top surface 121 and the pair of inclined surfaces 122 to the receding section 211A is more than 0 μm and less than 15 μm.

Figure 9:
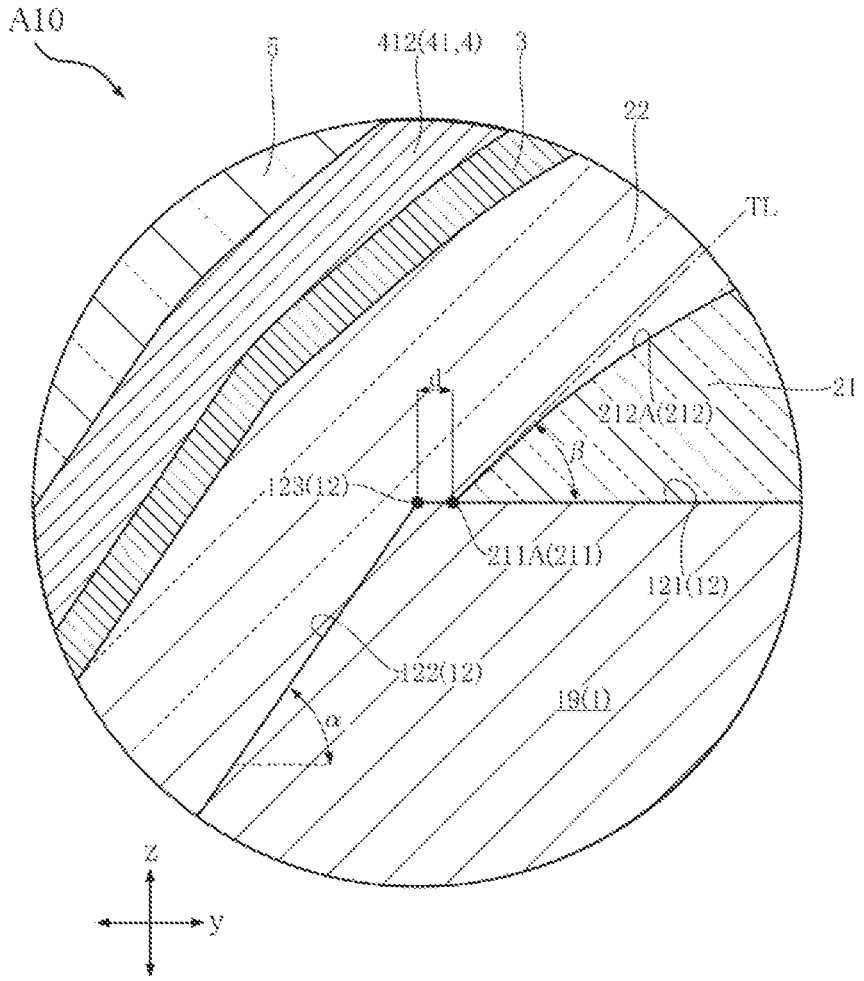
FIG. 9 is a cross-sectional diagram of FIG. 7 and FIG. 8 taken along the line IX-IX.
Figure 10:
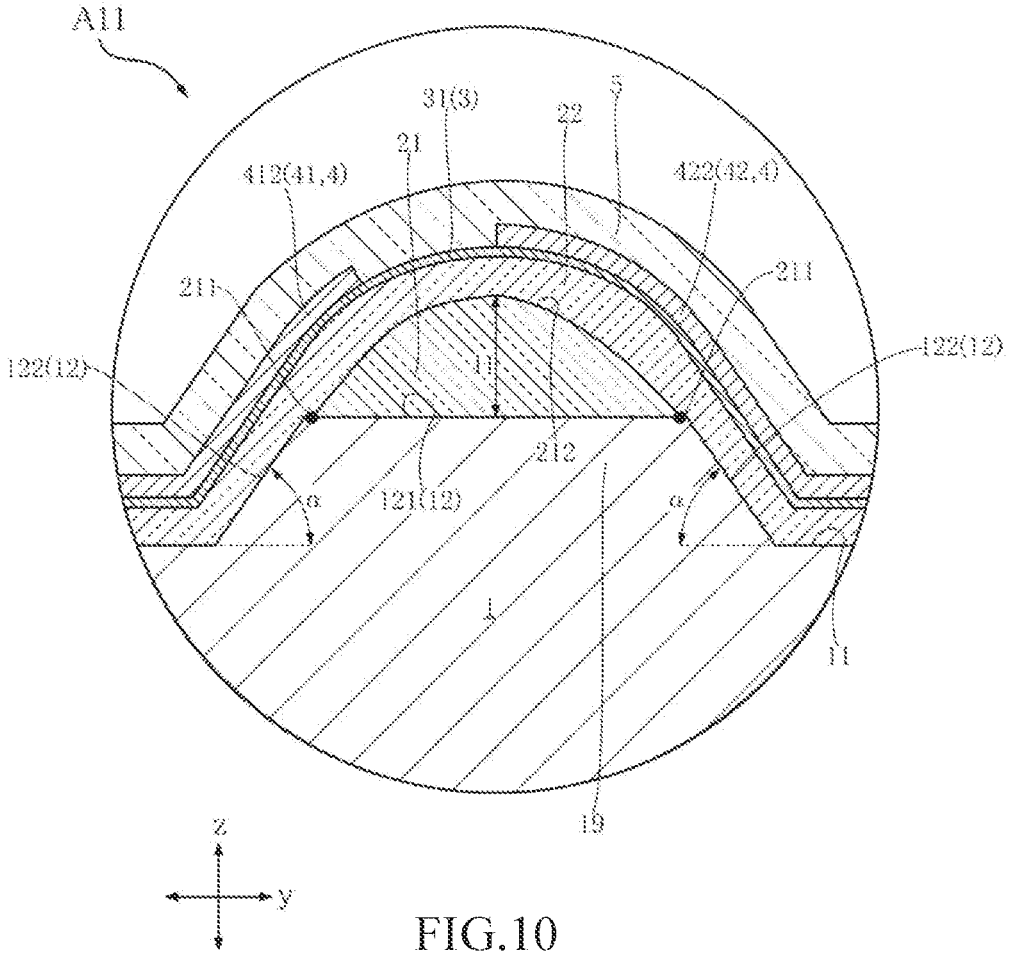
FIG. 10 is a partial enlarged sectional diagram of a variation example of the thermal print head in FIG. 1.

As shown in FIG. 9, the glaze layer 21 has a peripheral edge 212. The peripheral edge 212 is an edge of the glaze layer 21, and connects the pair of end edges 211 at a cross section in both the z direction and the y direction and protrudes toward one side which the top surface 121 faces in the z direction. At the cross section, the peripheral edge 212 is curved. At the cross section, the peripheral edge 212 includes an edge end portion 212A connected to any of the pair of end edges 211. The edge end portion 212A has a curved line. The curved line is convex toward one side that faces the top surface 121 of the protruding surface 12 of the substrate 1 in the z direction. At the cross section, an inclined angle β of a tangent line TL of the edge end portion 212A passing through the end edge 211 relative to the top surface 121 is less than the inclined angle α above.

As shown in FIG. 6, the insulation layer 22 covers the main surface 11 of the substrate 1, the pair of top surfaces 121 of the protruding surface 12 of the substrate 1, and the glaze layer 21. Using the insulation layer 22, the substrate 1 is electrically insulated from the resistance layer 3 and the wiring layer 4. The insulation layer 2 includes, for example, silicon dioxide ($SiO_2$) with tetraethyl orthosilicate (TEOS) as the raw material. The thickness of the insulation layer 22 is, for example, 1 μm or more and 15 μm or less.

As shown in FIG. 5 and FIG. 6, the resistance layer 3 is formed on the main surface 11 and the protruding surface 12 of the substrate 1. The resistance layer 3 is connected to the insulation layer 22. Thus, in the thermal print head A10, the insulation layer 22 is configured as being sandwiched between the substrate 1 and the resistance layer 3. The resistance layer 3 includes, for example, tantalum nitride (TaN). The thickness of the resistance layer 3 is, for example, 0.02 μm or more and 0.1 μm or less.

As shown in FIG. 2, FIG. 3 and FIG. 6, the resistance layer 3 includes the multiple heating portions 31. In the resistance layer 3, the multiple heating portions 31 are parts exposed from the wiring layer 4. Electricity is selectively supplied to the multiple heating portions 31 via the wiring layer 4, so that the multiple heating portions 31 partially heat the recording medium. The multiple heating portions 31 are arranged in the x direction. Among the multiple heating portions 31, two adjacent heating portions 31 in the x direction are arranged apart from each other. The multiple heating portions 31 are formed on the glaze layer 21. In the thermal print head A10, the multiple heating portions 31 are formed above the top surface 121 of the protruding surface 12 of the substrate 1. As shown in FIG. 4, in the thermal printer B10, the multiple heating portions 31 are opposite to the pressure roller 79. In the v direction, the multiple heating portions 31 are located at the center of the glaze layer 21 in the y direction.

FIG. 10 shows a partial enlarged sectional diagram of a thermal print head A11 as a variation example of the thermal print head A10. In the thermal print head A11, as shown in FIG. 10, in the y direction, the multiple heating portions 31 are located between the center of the glaze layer 21 in the y direction and one between the pair of the end edges 211 of the glaze layer 21. In the y direction, the multiple heating portions 31 are located above the glaze layer 21 and are shifted toward the downstream side. In the y direction, the end portion of the multiple heating portions 31 on the upstream side may be located above the center of the glaze layer 21 in the y direction, or may be shifted from above the center toward any side between the upstream side and the downstream side.

As shown in FIG. 5 and FIG. 6, the wiring layer 4 is formed in contact with the resistance layer 3. The wiring layer 4 forms a conductive path for supplying electricity to the multiple heating portions 31 of the resistance layer 3. The resistivity of the wiring layer 4 is less than the resistivity of the resistance layer 3. The wiring layer 4 is, for example, a metal layer including copper (Cu). The thickness of the wiring layer 4 is, for example, 0.3 μm or more and 2.0 μm or less. Moreover, the wiring layer 4 may be configured as including two metal layers, namely, a titanium (Ti) layer laminated on the resistance layer 3 and a copper layer laminated on the titanium layer. The thickness of the titanium layer in this case is, for example, 0.1 μm or more and 0.2 μm or less.

As shown in FIG. 2, the wiring layer 4 includes a common wire 41 and multiple independent wires 42. The common wire 41 is located on one side in the y direction relative to the multiple heating portions 31 of the resistance layer 3. The multiple independent wires 42 are located on the other side in the y direction relative to the multiple heating portions 31. As shown in FIG. 3, when observed in the z direction, multiple regions in the resistance layer 3 that are sandwiched between the common wire 41 and the multiple independent wires 42 are the multiple heating portions 31.

As shown in FIG. 2 and FIG. 3, the common wire 41 includes a base portion 411 and multiple extension portions 412. In the y direction, the base portion 411 is located at a position farthest away from the multiple heating portions 31 of the resistance layer 3. The base portion 411 is a strip extending in the x direction when observed in the z direction. The multiple extension portions 412 are strips extending from an end portion of the base portion 411 opposite to the protrusion 19 of the substrate 1 in the y direction toward the multiple heating portions 31. The multiple extension portions 412 are arranged in the x direction. A portion of each of the multiple extension portions 412 is formed on the inclined surface 122 facing the base portion 411 of the pair of inclined surfaces 122 of the substrate 1. Therefore, a portion of the common wire 41 is formed on any one of the pair of inclined surfaces 122. In the common wire 41, a current flows from the base portion 411 to the multiple heating portions 31 via the multiple extension portions 412.

As shown in FIG. 2 and FIG. 3, each of the independent wires 42 includes a base portion 421 and an extension portion 422. In the y direction, the base portion 421 is located at a position farthest away from the multiple heating portions 31 of the resistance layer 3. The base portions 421 of the multiple independent wires 42 are configured in a zigzag arrangement in the x direction. More specifically, the base portions 421 of the multiple independent wires 42 include two columns of base portions 421 respectively arranged in the x direction. In each column between the two columns of base portions 421, the multiple base portions 421 are arranged equidistantly by a gap p (the gap p is a distance between centers of two base portions 421 adjacent in the first direction x) in the x direction. Between the two columns of base portions 421, the one column of base portions 421 on the upstream side and the one column of base portions 421 on the downstream side are arranged as each having been shifted by ½ of the gap p in the x direction.

As shown in FIG. 2 and FIG. 3, the extension portions 422 is a strip extending in the y direction from an end portion of the base portion 421 opposite to the protrusion 19 of the substrate 1 toward the multiple heating portions 31. The extension portions 422 of the multiple independent wires 42 are arranged in the x direction. Each extension portion 422 of the multiple independent wires 42 is formed on the inclined surface 122 facing the base portion 421 of the multiple independent wires 42 among the pair of inclined surfaces 122 of the substrate 1. Therefore, each part of the multiple independent wires 42 is formed on any one of the pair of inclined surfaces 122. In each of the multiple independent wires 42, a current flows from any of the plurality of heating portions 31 to the base portion 421 via the extending portion 422. When observed in the z direction, each of the multiple heating portions 31 is sandwiched between any of the extension portions 422 of the multiple independent wires 42 and any of the multiple extension portions 412 of the common wire 41. In FIG. 2 and FIG. 3, the configurations of the wiring layer 4 and the multiple heating portions 31 are examples. The configurations of the wiring layer 4 and the multiple heating portions 31 of the disclosure are not limited to the exemplary configurations shown in FIG. 2 and FIG. 3.

As shown in FIG. 5, the protection layer 5 covers a part of the main surface 11 of the substrate 1, the multiple heating portions 31 of the resistance layer 3 and the wiring layer 4. The protection layer 5 is electrically insulative. The protection layer 5 includes silicon in the composition thereof. The protection layer 5 includes, for example, any of silicon dioxide, silicon nitride ($Si_3N_4$) and silicon carbide (SiC). Alternatively, the protection layer 5 may be a laminated body including varieties of the substances above. The thickness of the protection layer 5 is, for example, 1.0 μm or more and 10 μm or less. In the thermal printer B10, the recording medium is pressed by the pressure roller 79 shown in FIG. 4 against the region of the protection layer 5 covering the multiple heating portions 31.

As shown in FIG. 5, a wire opening 51 is provided on the protection layer 5. The wire opening 51 passes through the protection layer 5 in the z direction. A part of each of the base portions 421 of the multiple independent wires 42 and the extension portions 422 of the multiple independent wires 42 is exposed from the wire opening 51.

As shown in FIG. 4, the wiring substrate 71 is located next to the substrate 1 in the y direction. As shown in FIG. 1, the multiple independent wires 42 are located between the multiple heating portions 31 of the resistance layer 3 and the wiring substrate 71 in the y direction, when observed in the z direction. The area of the wiring substrate 71 is greater than the area of the substrate 1, when observed in the z direction. Moreover, when observed in the z direction, the wiring substrate 71 is a rectangle having the x direction as the lengthwise direction. The wiring substrate 71 is, for example, a printed circuit board (PCB) substrate. Multiple driving elements 73 and a connector 77 are mounted on the wiring substrate 71.

As shown in FIG. 4, the heat dissipation plate 72 is opposite to the back surface 13 of the substrate 1. The back surface 13 is joined to the heat dissipation plate 72. The wiring substrate 71 is fixed on the heat dissipation plate 72 by fastening components such as screws. During the use of the thermal print head A10, a part of heat energy generated by the multiple heating portions 31 of the resistance layer 3 is conducted through the substrate 1 to the heat dissipation plate 72. The heat conducted to the heat dissipation plate 72 is released to the exterior. The heat dissipation plate 72 includes, for example, aluminum (Al).

As shown in FIG. 1 and FIG. 4, the multiple driving elements 73 are interposed by an electrically insulative chip bonding material (omitted from the drawing) and thus mounted on the wiring substrate 71. The multiple driving elements 73 are semiconductor components respectively forming various circuits. Each of the multiple driving elements 73 is bonded to one end of each of multiple first conducting wires 74 and one end of each of multiple second conducting wires 75. The other end of each of the multiple conducting wires 74 is independently bonded to the base portions 421 of the multiple independent wires 42. The other end of each of the multiple second conducting wires 75 is bonded to a wire (omitted from the drawing) which is provided at the wiring substrate 71 and is in electrical conduction with the connector 77. Accordingly, a printing signal, a control signal and a voltage supplied to the multiple heating portions 31 of the resistance layer 3 are inputted from the exterior to the multiple driving elements 73 through the connector 77. The multiple driving elements 73 selectively apply a voltage on the multiple independent wires 42 according to these electrical signals. Accordingly, the multiple heating portions 31 selectively generate heat.

As shown in FIG. 4, the sealing resin 76 covers a part of each of the multiple driving elements 73, the multiple first conducting wires 74, the multiple second conducting wires 75, the substrate 1 and the wiring substrate 71. The sealing resin 76 is electrically insulative. The sealing resin 76 is, for example, a black and soft composite resin as an adhesive for filling the bottom. Moreover, the sealing resin 76 may also be, for example, a black and hard composite resin.

The connector 77 is mounted on one end of the wiring substrate 71 in the y direction, as shown in FIG. 1 and FIG. 4. The connector 77 is connected to the thermal printer B10. The connector 77 has multiple pins (omitted from the drawing). A part of the multiple pins are in electrical conduction with wires (omitted from the drawing) bonded with the multiple second conducting wires 75 in the wiring substrate 71. Accordingly, another part of the multiple pins are in electrical conduction with the following wires (omitted from the drawing) in the wiring substrate 71, wherein the wires are in electrical conduction with the base portion 411 of the common wire 41.

Details of an example of a manufacturing method of the thermal print head A10 are given with reference to FIG. 11 to FIG. 22 below. Herein, positions of the cross sections of FIG. 11 to FIG. 13 and FIG. 16 and FIG. 22 are the same as the position of the cross section for representing the main part of the thermal print head A10 in FIG. 5.

Figure 11:
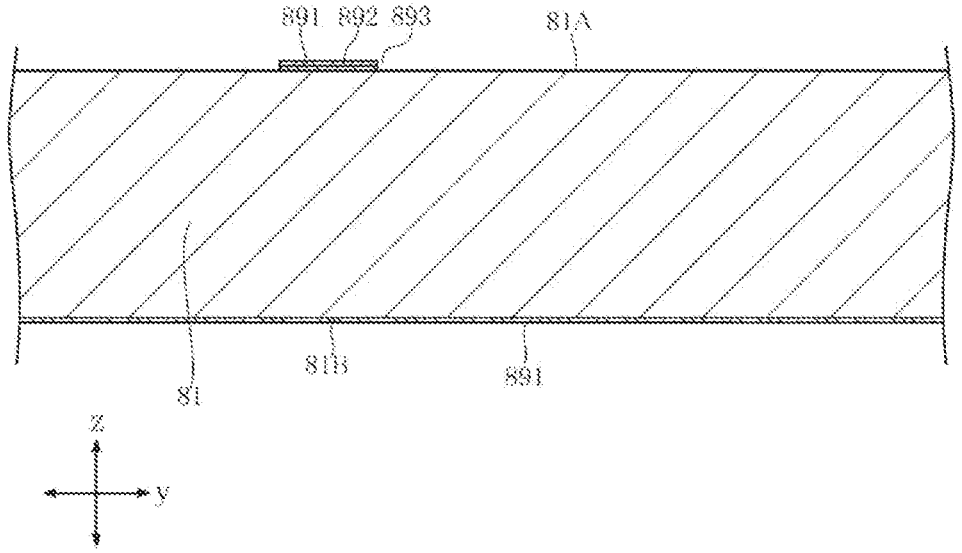
FIG. 11 is a cross-sectional diagram for illustrating a manufacturing step for the main part of the thermal print head in FIG. 1.
Figure 12:
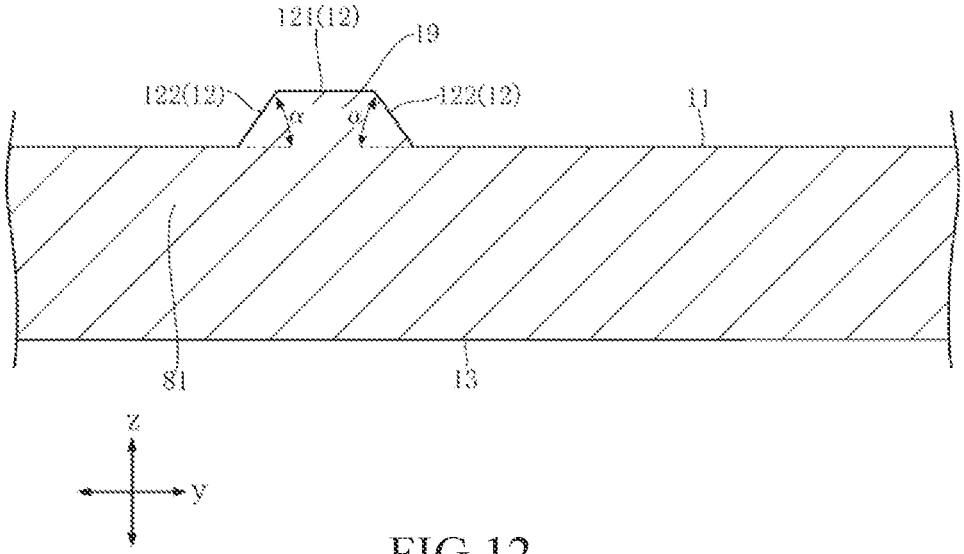
FIG. 12 is a cross-sectional diagram for illustrating a manufacturing step for the main part of the thermal print head in FIG. 1.

Initially, as shown in FIG. 11 and FIG. 12, the protrusion 19 is formed on a base material 81.

First, as shown in FIG. 11, a first mask layer 891 covering the base material 81 and a second mask layer 892 covering a part of the first mask layer 891 are formed. The base material 81 includes a semiconductor material. The semiconductor material includes a monocrystalline material including silicon. The base material 81 is a silicon wafer. In a direction perpendicular to the z direction, multiple parts equivalently formed by connecting regions of multiple substrates 1 are equivalent to the base material 81. The base material 81 has a first surface 81A and a second surface 81B. The first surface 81A and the second surface 81B face opposite sides from each other in the z direction. The surface orientations of the first surface 81A and the second surface 81B of the crystalline structure based on the base material 81 are both (100) surfaces. The first mask layer 891 is formed in a manner of covering the first surface 81A and the second surface 81B. The first mask layer 891 includes silicon dioxide. The second mask layer 892 is formed in a manner of covering a region of the first mask layer 891 that covers the first surface 81A. The second mask layer 892 includes silicon nitride. A mask opening 893 that passes through in the z direction is formed in the region of the first mask layer 891 covering the first surface 81A and the second mask layer 892 covering the region.

To form the first mask layer 891 and the second mask layer 892, a silicon dioxide film covering the first surface 81A and the second surface 81B is first formed by means of thermal oxidation. Next, a silicon nitride film covering the region of the first mask layer 891 that covers the first surface 81A is formed by means of thermal chemical vapor deposition (CVD). Lastly, a part of the region of the silicon dioxide film covering the first surface 81A and a part of the silicon nitride film covering the region are removed by means of photolithographic patterning and reactive ion etching (RIE). Accordingly, the first mask layer 891 and the second mask layer 892 are formed, and the mask opening 893 is formed in the region of the first mask layer 891 covering the first surface 81A and the second mask layer 892 covering the region.

As the first mask layer 891, a silicon nitride film covering the first surface 81A and the second surface 81B may also be formed by means of thermal CVD. In this case, by means of photolithographic patterning and RIE, a specified region covered by the first mask layer 891 is formed on the first surface 81A, and a region outside that region and exposed from the first surface 81A, i.e., the mask opening 893, is formed.

Next, as shown in FIG. 12, the main surface 11 and the protrusion 19 are formed on the base material 81. The main surface 11 and the protrusion 19 are formed, by means of wet etching using aqueous solution of potassium hydroxide (KOH), in the region of the first surface 81A exposed from the mask opening 893 shown in FIG. 11. The etching is anisotropic. Lastly, the first mask layer 891 and the second mask layer 892 are removed by means of wet etching using hydrofluoric (HF) acid. By the processes above, the main surface 11 and the protrusion 19 are formed on the base material 81. Further, the second surface 81B of the base material 81 becomes the back surface 13. The protruding surface 12 is connected to the main surface 11, and protrudes in the z direction from the main surface 11. The protrusion 19 protrudes in the z direction from the main surface 11 and extends in the x direction. The protrusion 19 includes the protruding surface 12. A region of the first surface 81A covered by the first mask layer 891 and the second mask layer 892 becomes the top surface 121 of the protruding surface 12. Accordingly, respective inclined angles $\alpha$ of the pair of inclined surfaces 122 of the protruding surface 12 relative to the main surface 11 are equal. This is because the protrusion 19 is formed by anisotropic etching.

Alternatively, after the main surface 11 and the protrusion 19 are formed on the base material 81, a silicon dioxide film covering the main surface 11 may be formed by means of thermal oxidation. The metal layer is sometimes laminated by plating on the base portions 421 of the multiple independent wires 42, and the multiple independent wires 42 are individually bonded to multiple first conducting wires 74. When the metal layer is laminated by plating, the silicon dioxide film provides a function of suppressing abnormal growth of the metal layer.

Figure 13:
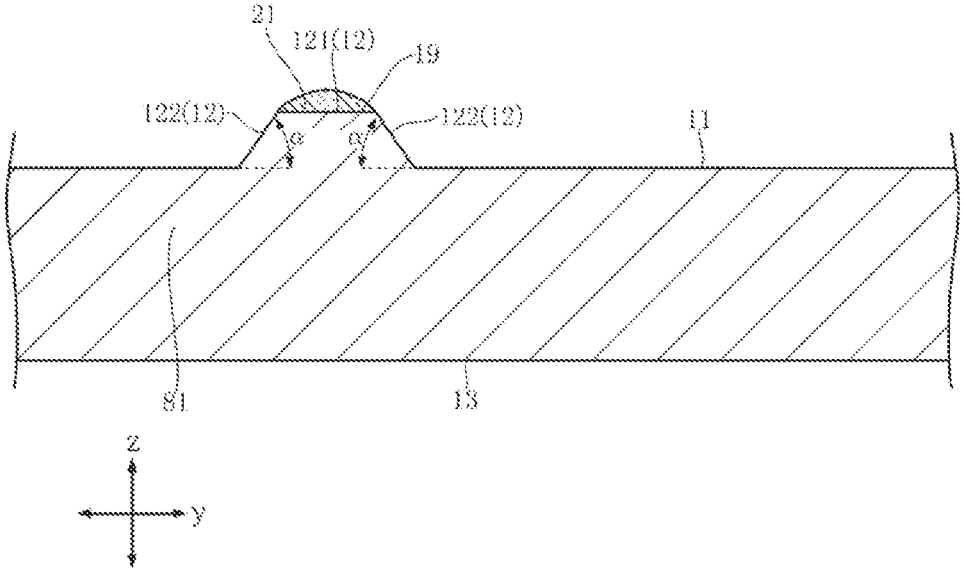
FIG. 13 is a cross-sectional diagram for illustrating a manufacturing step for the main part of the thermal print head in FIG. 1.
Figure 14:
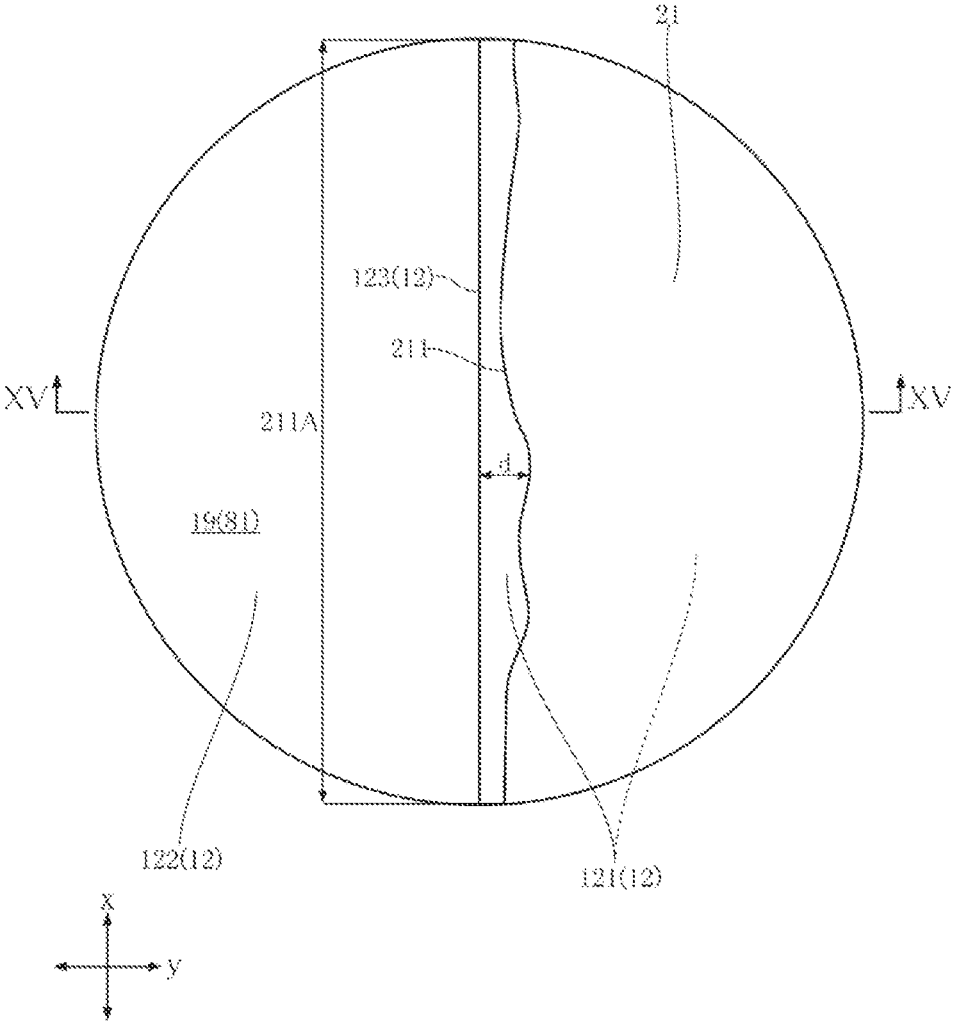
FIG. 14 is a partial enlarged top view corresponding to the cross-sectional diagram of FIG. 13.
Figure 15:
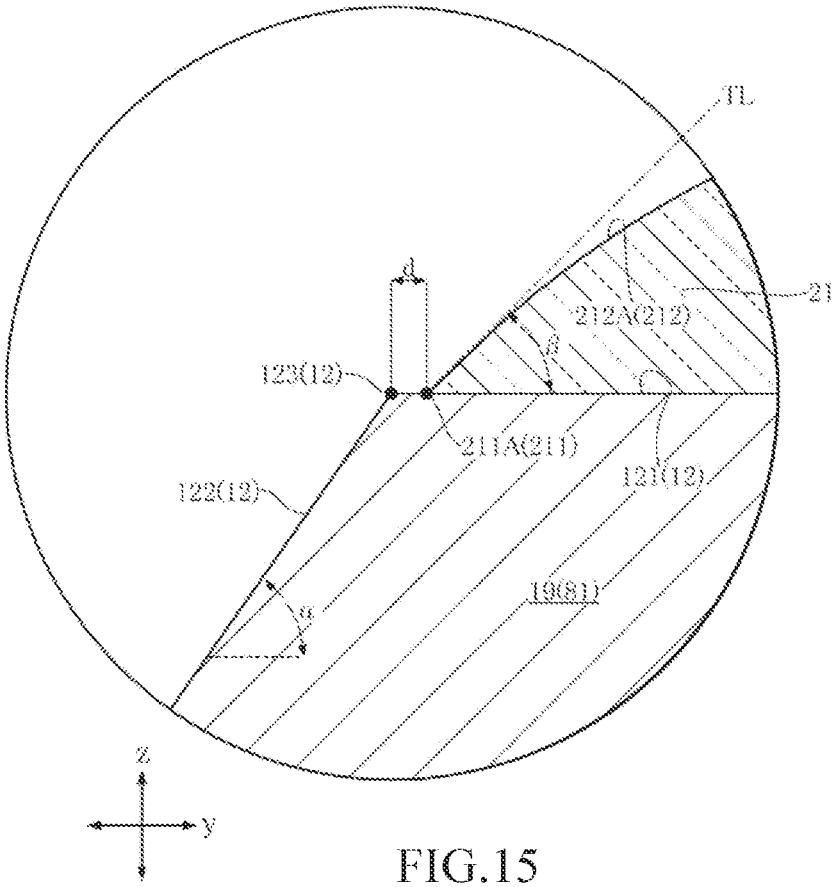
FIG. 15 is a cross-sectional diagram of FIG. 14 taken along the line XV-XV.

Next, as shown in FIG. 13, the glaze layer 21 is formed in contact with the top surface 121 of the protruding surface 12 of the base material 81. The glaze layer 21 is formed by supplying a glaze material in a fluid to the top surface 121 and then sintering the glaze material. The glaze material is, for example, sprayed by a distributor. The glaze material includes a glass material such as amorphous glass. The glaze material may also undergo repeated coating for multiple times. The glaze material is contracted as a result of the sintering. Thus, as shown in FIG. 14 and FIG. 15, a pair of end edges 211 of the glaze layer 21 then become a structure that includes the receding section 211A (the situation in FIG. 7 is an example of this manufacturing method) described above. In another example of supplying the glaze material, in an exemplary method, the glaze material may be printed to the top surface 121 by a wire mesh.

Figure 16:
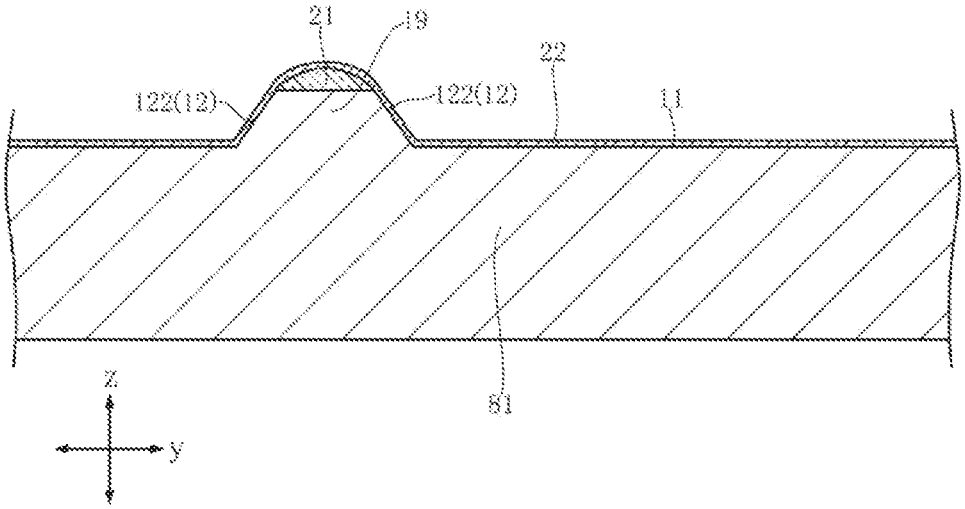
FIG. 16 is a cross-sectional diagram for illustrating a manufacturing step for the main part of the thermal print head in FIG. 1.

Then, as shown in FIG. 16, the insulation layer 22 covering the main surface 11 of the base material 81, the pair of inclined surfaces 122 of the protruding surface 12 of the base material 81 and the glaze layer 21 is formed. The insulation layer 22 is formed, for example, by laminating a silicon dioxide film formed by using tetraethyl orthosilicate (TEOS) as the raw material for multiple times by means of plasma CVD.

Next, as shown in FIG. 17 to FIG. 20, the resistance layer 3 and the wiring layer 4 are formed. The resistance layer 3 includes the multiple heating portions 31 arranged in the x direction. The wiring layer 4 is in electrical conduction with the multiple heating portions 31. Accordingly, the step of forming the wiring layer 4 includes a step of forming the common wire 41 and the multiple independent wires 42. In the base material 81, the common wire 41 is located on one side in the y direction relative to the multiple heating portions 31 of the resistance layer 3 shown in FIG. 20. In the base material 81, the multiple independent wires 42 are located on the other side in the y direction relative to the multiple heating portions 31 shown in FIG. 20.

Figure 17:
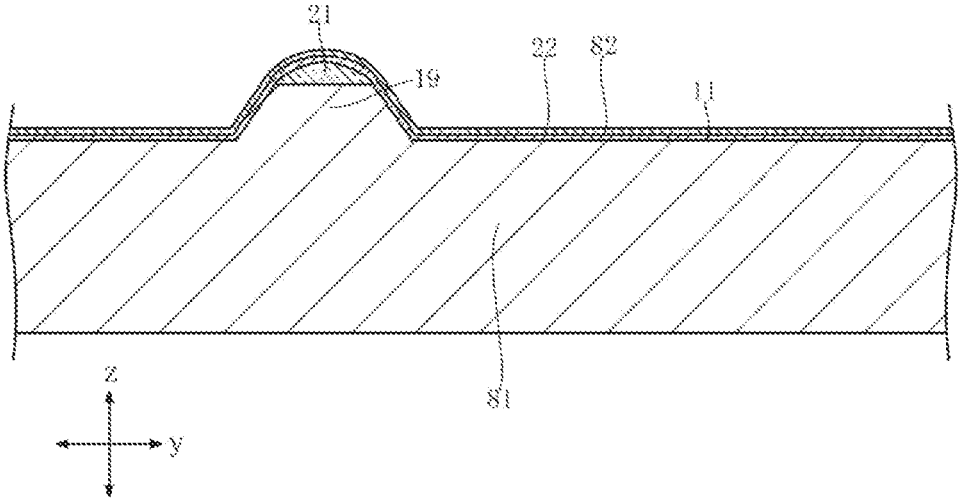
FIG. 17 is a cross-sectional diagram for illustrating a manufacturing step for the main part of the thermal print head in FIG. 1.

First, as shown in FIG. 17, a resistance film 82 is formed on the main surface 11 and the protruding surface 12 of the base material 81. The resistance film 82 is formed in a manner of covering the entire surface of the insulation layer 22. The resistance film 82 is formed by laminating a tantalum nitride film on the insulation layer 22 by means of sputtering.

Figure 18:
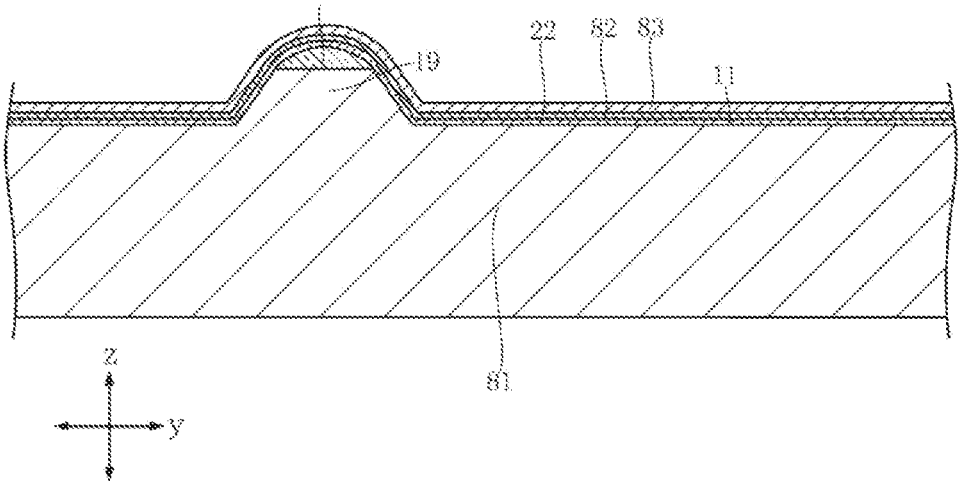
FIG. 18 is a cross-sectional diagram for illustrating a manufacturing step for the main part of the thermal print head in FIG. 1.

Next, as shown in FIG. 18, a conductive layer 83 covering the entire surface of the resistance film 82 is formed. The conductive layer 83 is formed by laminating a copper film on the resistance film 82 for multiple times by means of sputtering. Further, when forming the conductive layer 83, the following method may also be adopted: after laminating a titanium film on the resistance film 82 by means of sputtering, laminating a copper film for multiple times on the titanium film by means of sputtering.

Figure 19:
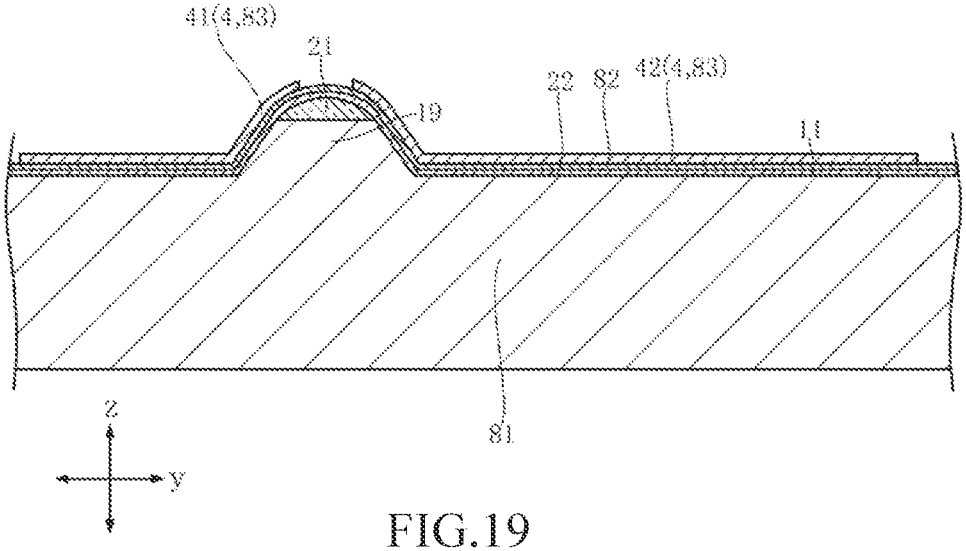
FIG. 19 is a cross-sectional diagram for illustrating a manufacturing step for the main part of the thermal print head in FIG. 1.

Next, as shown in FIG. 19, a part of the conductive layer 83 is removed after performing photolithographic patterning on the conductive layer 83. The removing is performed by means of wet etching using mixed solution of sulphuric acid ($H_2SO_4$) and hydrogen peroxide ($H_2O_2$). Accordingly, the common wire 41 and the multiple independent wires 42 are formed in contact with the resistance film 82. Thus, the wiring layer 4 is formed by the steps above. Moreover, a region of the resistance film 82 formed on the top surface 121 of the protruding surface 12 of the base material 81 is exposed from the wiring layer 4.

Figure 20:
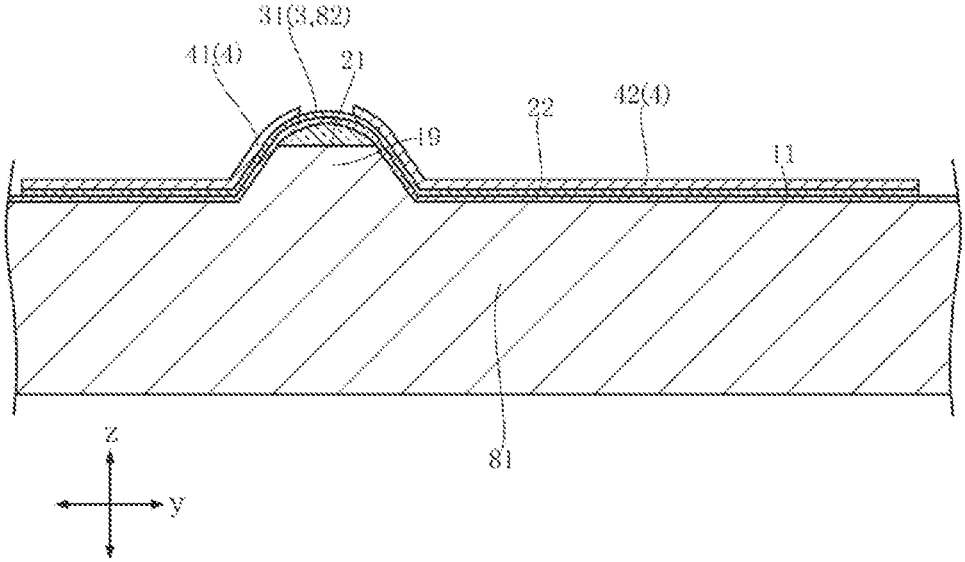
FIG. 20 is a cross-sectional diagram for illustrating a manufacturing step for the main part of the thermal print head in FIG. 1.

Next, as shown in FIG. 20, a part of the resistance film 82 is removed after performing photolithographic patterning on the resistance film 82 and the wiring layer 4. The removing is performed by means of RIE. Accordingly, the resistance layer 3 is formed on the main surface 11 and the protruding surface 12 of the base material 81. On the top surface 121 of the base material 81, the multiple heating portions 31 then appear.

Figure 21:
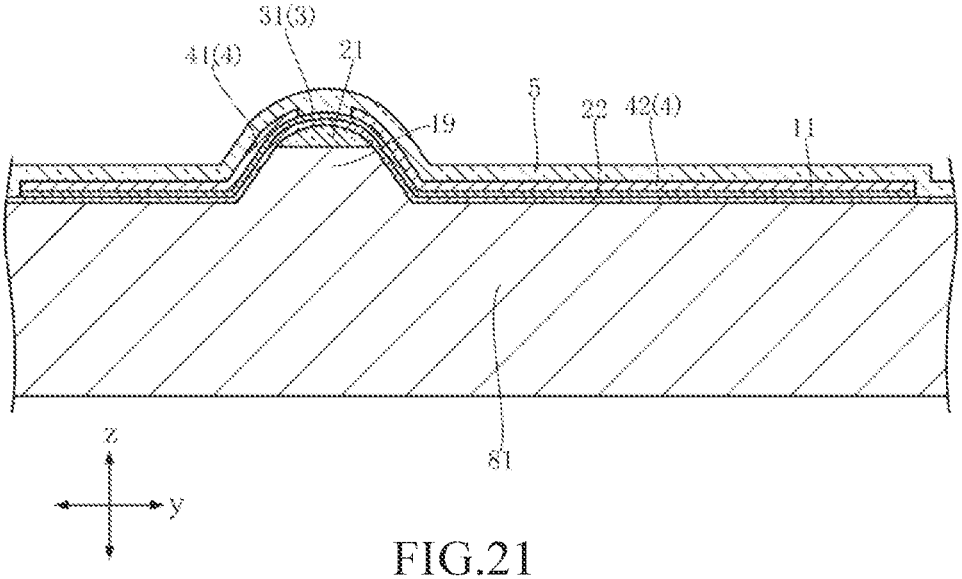
FIG. 21 is a cross-sectional diagram for illustrating a manufacturing step for the main part of the thermal print head in FIG. 1.

Next, as shown in FIG. 21, the protection layer 5 covering a part of the main surface 11 of the base material 81, the multiple heating portions 31 of the resistance layer 3 and the wiring layer 4 is formed. The protection layer 5 is formed by laminating a silicon nitride film by means of plasma CVD.

Figure 22:
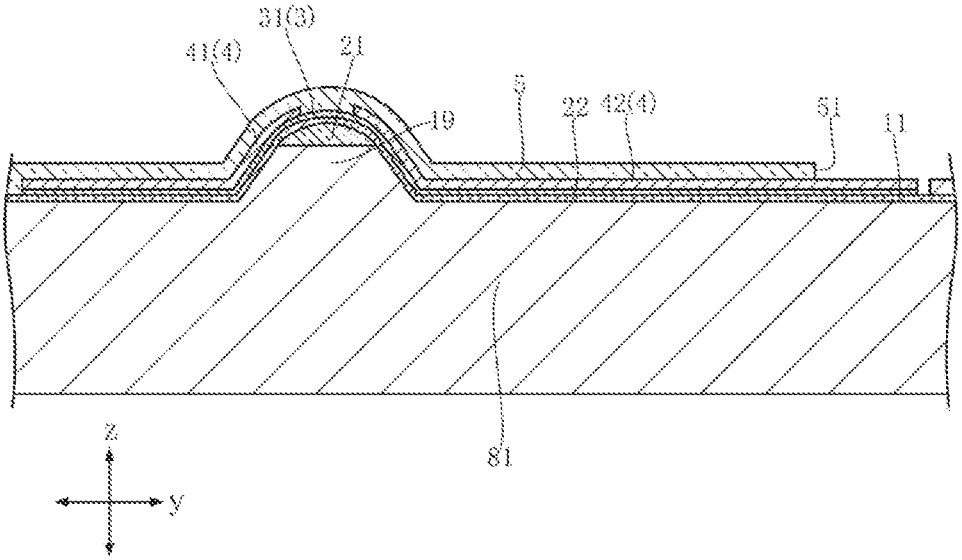
FIG. 22 is a cross-sectional diagram for illustrating a manufacturing step for the main part of the thermal print head in FIG. 1.

Next, as shown in FIG. 22, the wire opening 51 passing through in the z direction is formed on the protection layer 5. The wire opening 51 is formed by removing a part of the protection layer 5 after performing photolithographic patterning on the protection layer 5. The removing is performed by means of RIE. A part of the multiple independent wires 42 (a part of each of the base portions 421 of the multiple independent wires 42 and the extension portions 422 of the multiple independent wires 42 shown in FIG. 5) is exposed from the wire opening 51. The part serving as a part of each of the multiple independent wires 42 and exposed from the wire opening 51 forms the base portion 421 to which a plurality of first conducting wires 74 are individually bonded by wire bonding, for example. A metal layer such as gold may be laminated by plating on each part (including the base portion 421) of the multiple independent wires 42 exposed from the wire opening 51.

Next, the base material 81 is cut along the x direction and the y direction to cut the base material 81 into single pieces. Accordingly, the main part of the thermal print head A10 including the substrate 1 can be obtained. Next, the multiple driving elements 73 and the connector 77 are mounted on the wiring substrate 71. Next, the back surface 13 of the substrate 1 and the wiring substrate 71 are joined to the heat dissipation plate 72. Next, the multiple first conducting wires 74 and the multiple second conducting wires 75 are joined for the wiring substrate 71. Lastly, the sealing resin 76 covering the driving elements 73, the multiple first conducting wires 74 and the multiple second conducting wires 75 is formed for the substrate 1 and the wiring substrate 71. The thermal print head A10 is obtained by the steps above.

Next, effects of the thermal print head A10 are described below.

The thermal print head A10 includes the glaze layer 21 formed in contact with the top surface 121 of the protruding surface 12 of the substrate 1. The glaze layer 21 has the pair of end edges 211 arranged apart from each other in the y direction. The multiple heating portions 31 of the resistance layer 3 are formed on the glaze layer 21. When observed in a z direction, each of the pair of end edges 211 includes the receding section 211A, and the receding section 211A is located closer to the inner side of the top surface 121 than the junction 123 of the top surface 121 and the pair of inclined surfaces 122 of the protruding surface 12.

The pair of end edges 211 each including the glaze layer 21 of the receding section 211A are obtained by the following method in the manufacturing process of the thermal print head A10 shown in FIG. 13: after forming the protrusion 19 including the protruding surface 12 on the base material 81, applying a liquid glaze material onto the top surface 121 of the protruding surface 12, and sintering the glaze material. With the manufacturing method above, the surface tension at the junction 123 of the top surface 121 and the pair of inclined surfaces 122 of the protruding surface 12 acts on the glaze material before sintering. With the function of the surface tension, deviation in the shape (the peripheral edge 212) of the glaze material 21 can be suppressed. By including the glaze layer 21 in the thermal print head A10, the scale of the protrusion 19 formed can be suppressed, and a contact area between the recording medium and the thermal print head A10 becomes smaller. Thus, the glaze layer 21 provides an effect of accumulating the heat emitted from the multiple heating portions 31. Hence, first of all, improved printing energy efficiency can be achieved according to the thermal print head A10. Secondly, printing quality of the recording medium can be enhanced using the multiple heating portions 31. Thirdly, the glaze layer 21 can be efficiently formed on the substrate 1, and improved shape precision of the glaze layer 21 can be achieved The glaze layer 21 protrudes toward one side which the top surface 121 of the protruding surface 12 faces in the z direction. In this case, it is ideal that the peripheral edge 212 of the glaze layer 12 is curved at a cross section in both the z direction and the y direction. Thus, the shapes of each of parts of the multiple heating portions 31 formed on the glaze layer 21 and the wiring layer 4 can be smoother. This is conducive to enhancing printing quality of the recording medium using the multiple heating portions 31.

The size H of the glaze layer 21 in the z direction (referring to FIG. 6) is the greatest at the center of the glaze layer 21 in the y direction. Thus, in the y direction, the multiple heating portions 31 are located at the center of the glaze layer 21 in the y direction. Accordingly, the recording medium is partially in contact with the multiple heating portions 31 during the use of the thermal print head A10. Thus, the range of the recording medium thermally affected by the multiple heating portions 31 is prevented from expanding excessively, thereby helping enhance printing quality of the recording medium using the multiple heating portions 31.

At the cross section in both the z direction and the y direction, the peripheral edge 212 of the glaze layer 21 includes an edge end portion 212A connected to any one between the pair of end edges 211. The edge end portion 212A has a curved line. The curved line is convex toward one side that faces the top surface 121 of the protruding surface 12 in the z direction. As shown in FIG. 9, at the cross section, the inclined angle β of a tangent line TL of the edge end portion 212A passing through the end edges 211 relative to the top surface 121 is less than the inclined angle α of each of the pair of inclined surfaces 122 of the protruding surface 12 relative to the main surface 11. Such configuration is an exhibition that the surface tension acting on the liquid glaze material is in a state suitable for improving the shape precision of the glaze layer 21 in the manufacturing process of the thermal print head A10 shown in FIG. 13.

In the thermal print head A10, a part of the common wire 41 and a part of each of the multiple independent wires 42 are formed on any one of the pair of inclined surfaces 122 of the protruding surface 12. Accordingly, when observed in the z direction, respective sizes of the multiple heating portions 31 in the y direction can be smaller, and the contact area between the recording medium and the thermal print head A10 can be further reduced during the use of the thermal print head A10. Thus, the amount of heat generated by the thermal print head A10 can be suppressed, and printing quality of the recording medium can be further enhanced.

In the substrate 1, the pair of inclined surfaces 122 are inclined relative to the main surface 11 in a manner of approaching each other from the main surface 11 to the top surface 121. Such shape of the protruding surface 12 is shown by the protrusion 19 formed at the base material 81 using anisotropic etching in the manufacturing process of the thermal print head A10 shown in FIG. 12. This is because the base material 81 includes a semiconductor material, and the semiconductor material includes a monocrystalline material including silicon.

The thermal print head A10 includes the protection layer 5 covering the insulation layer 22, the plurality of heating portions 31 and the wiring layer 4. Accordingly, the multiple heating portions 31 and the wiring layer 4 are protected by the protection layer 5, and friction of the recording medium against the thermal print head A10 can be reduced during the use of the thermal print head A10.

The thermal print head A10 further includes the heat dissipation plate 72. The back surface 13 of the substrate 1 is joined to the heat dissipation plate 72. Accordingly, during the use of the thermal print head A10, a part of heat energy generated by the multiple heating portions 31 is rapidly released to the exterior through the substrate 1 and the heat dissipation plate 72.

Second Embodiment

On the basis of FIG. 23 and FIG. 24, a thermal print head A20 according to a second embodiment of the disclosure is described below. In these drawings, elements the same as or similar to those of the thermal print head A10 described above are provided with the same numerals and denotations, and repeated description is omitted. Herein, the position of the cross section of FIG. 23 is the same as the position of the cross section of the thermal print head A10 in FIG. 5 in the description above.

In the thermal print head A20, the configuration of the protruding surface 12 of the substrate 1, and the configuration of the multiple heating portions 31 of the resistance layer 3 are different from the configurations of those in the thermal print head A10 described above.

Figure 23:
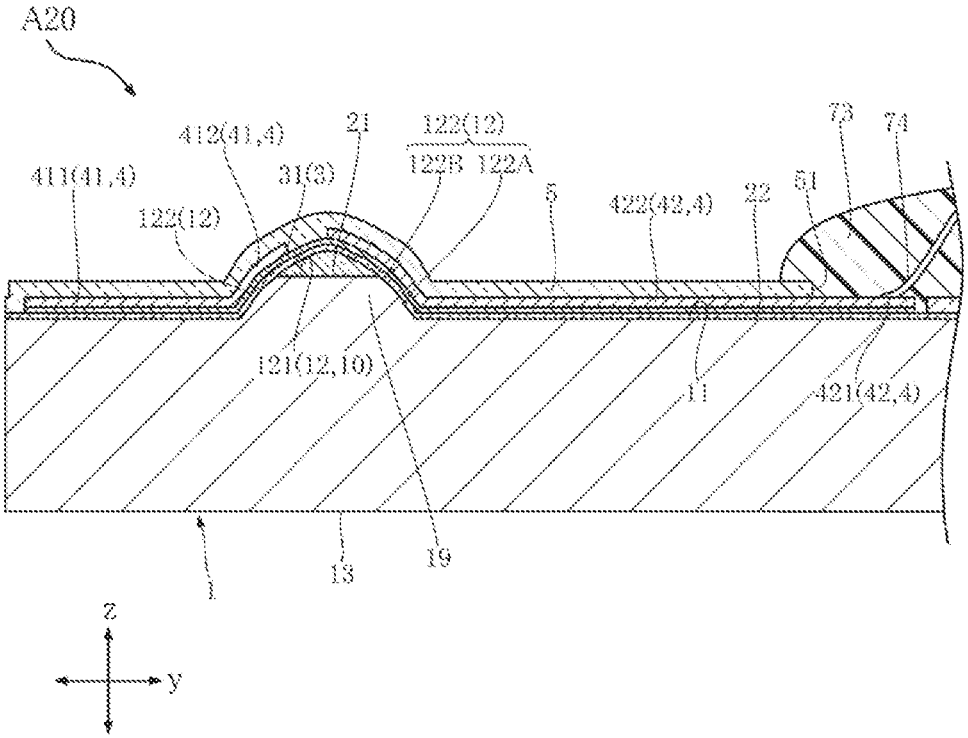
FIG. 23 is a cross-sectional diagram of a main part of a thermal print head according to a second embodiment of the disclosure.
Figure 24:
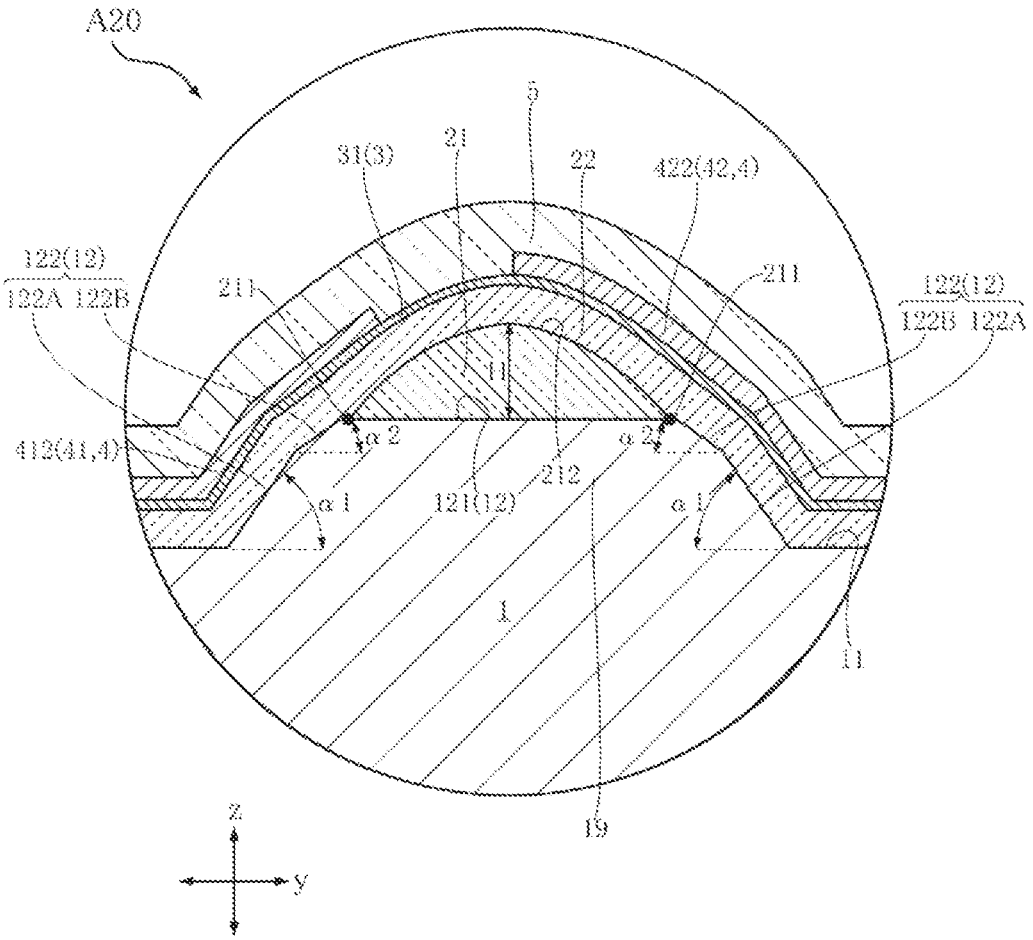
FIG. 24 is a partial enlarged view of FIG. 23.

As shown in FIG. 23 and FIG. 24, each of the pair of inclined surfaces 122 of the protruding surface 12 includes a first region 122A and a second region 122B. The first region 122A is connected to the main surface 11 of the substrate 1. The second region 122B is connected to the top surface 121 of the protruding surface 12 and the first region 122A. In each of the pair of inclined surfaces 122, an inclined angle α2 of the second region 122B relative to the main surface 11 is less than an inclined angle α1 of the first region 122A relative to the main surface 11. Such pair of inclined surfaces 122 are formed, between the step shown in FIG. 12 and the step shown in FIG. 13, by implementing wet etching using aqueous solution of tetramethylammonium hydroxide (TMAH) on the junction 123 and the vicinity of the top surface 121 and the pair of inclined surfaces 122.

As shown in FIG. 24, the multiple heating portions 31 of the resistance layer 3 are formed in the following manner. Firstly, in the y direction, the multiple heating heating portions 31 are located above the glaze layer 21 and are shifted toward the downstream side. Secondly, in the y direction, the end portion of the multiple heating portions 31 on the upstream side may be located above the center of the glaze layer 21 in the y direction, or may be shifted from above the center toward any side between the upstream side and the downstream side.

Next, effects of the thermal print head A20 are described below.

The thermal print head A20 includes the glaze layer 21 formed in contact with the top surface 121 of the protruding surface 12 of the substrate 1. The glaze layer 21 has the pair of end edges 211 arranged apart from each other in the y direction. The multiple heating portions 31 of the resistance layer 3 are formed on the glaze layer 21. When observed in the z direction, each of the pair of end edges 21 includes the receding section 211A, and the receding section 211A is located closer to the inner side of the top surface 121 than the junction 123 of the top surface 121 and the pair of inclined surfaces 122 of the protruding surface 12. By including the glaze layer 21 in the thermal print head A20, the scale of the protrusion 19 formed can be suppressed, and a contact area between the recording medium and the thermal print head A20 becomes smaller. Thus, the glaze layer 21 provides an effect of accumulating the heat emitted from the multiple heating portions 31. Hence, first of all, improved printing energy efficiency can be achieved according to the thermal print head A20. Secondly, printing quality of the recording medium can be enhanced using the multiple heating portions 31. Thirdly, the glaze layer 21 can be efficiently formed on the substrate 1, and improved shape precision of the glaze layer 21 can be achieved In the thermal print head A20, each of the pair of inclined surfaces 122 of the protruding surface 12 includes the first region 122A and the second region 122B. The first region 122A is connected to the main surface 11 of the substrate 1. The second region 122B is connected to the top surface 121 of the protruding surface 12 and the first region 122A. In each of the pair of inclined surfaces 122, an inclined angle α2 of the second region 122B relative to the main surface 11 is less than an inclined angle α1 of the first region 122A relative to the main surface 11. Using the structure above, the shape of a part of the wiring layer 4 formed along the protruding surface 12 is smoother. Moreover, in the wiring layer 4 formed along the protruding surface 12, occurrences of damage and breaking of wiring patterns are suppressed.

The disclosure is not limited to the embodiments described above. Various design modifications may be made as desired to the specific structures of the components of the disclosure.

Notes regarding the thermal print head, the manufacturing method of the thermal print head, and the thermal printer provided by the disclosure are given below.

[Note 1]

A thermal print head, being characterized in comprising:

a substrate, having a main surface facing a thickness direction, and a protruding surface connected to the main surface and protruding toward one side which the main surface faces in the thickness direction;

a resistance layer, comprising a plurality of heating portions arranged in a main scan direction, and formed on the main surface and the protruding surface; and a wiring layer, formed in contact with the resistance layer, and conductive to the plurality of heating portions;

wherein the protruding surface comprises a top surface parallel to the main surface, and a pair of inclined surfaces connected to the top surface and the main surface and arranged apart from each other in a secondary scan direction:

the thermal print head further comprises a glaze layer, the glaze layer having a pair of end edges arranged apart from each other in the secondary scan direction and formed in contact with the top surface:

the plurality of heating portions are formed on the glaze layer: and when observed in the thickness direction, each of the pair of end edges comprises a receding section, the receding section is located closer to an inner side of the top surface than a junction of the top surface and the pair of inclined surfaces.

[Note 2]

The thermal print head according to note 1, wherein the protruding surface extends along the main scan direction, and the glaze layer protrudes toward one side which the top surface faces in the thickness direction.

[Note 3]

The thermal print head according to note 2, wherein a distance from any between junctions of the top surface and the pair of inclined surfaces to the receding section is more than 0 m and less than 15 μm.

[Note 4]

The thermal print head according to note 2 or 3, wherein a peripheral edge of the glaze layer is curved at a cross section in both directions including the thickness direction and the secondary scan direction.

[Note 5]

The thermal print head according to note 4, wherein a size of the glaze layer in the thickness direction is greatest in a center of the glaze layer in the secondary scan direction.

[Note 6]

The thermal print head according to note 5, wherein in the secondary scan direction, the plurality of heating portions are located at the center of the glaze layer in the secondary scan direction.

[Note 7]

The thermal print head according to note 5, wherein in the secondary scan direction, the plurality of heating portions are located between the center of the glaze layer in the secondary scan direction and one between the pair of end edges.

[Note 8]

The thermal print head according to any one of notes 4 to 7, wherein at the cross section, the peripheral edge of the glaze layer comprises an edge end portion connected to any between the pair of end edges, the edge end portion has a curved line. The curved line is convex toward one side that faces the top surface in the thickness direction; and at the cross section, an inclined angle of a tangent line of the edge end portion passing through the end edges relative to the top surface is less than an inclined angle of each of the pair of inclined surfaces relative to the main surface.

[Note 9]

The thermal print head according to any one of notes 1 to 8, wherein the glaze layer comprises a glass-containing material.

[Note 10]

The thermal print head according to any one of notes 1 to 9, wherein the pair of inclined surfaces are inclined in a manner of approaching each other from the main surface to the top surface.

[Note 11]

The thermal print head according to note 10, wherein each of the pair of inclined surfaces comprises a first region connected to the main surface, and a second region connected to the top surface and the first region, and an inclined angle of the second region relative to the main surface is less than an inclined angle of the first region relative to the main surface.

[Note 12]

The thermal print head according to any one of notes 1 to 11, wherein the substrate comprises a semiconductor material, and the semiconductor material comprises a monocrystalline material including silicon.

[Note 13]

The thermal print head according to any one of notes 1 to 12, further comprising an insulation layer covering the main surface, the pair of inclined surfaces and the glaze layer, wherein the resistance layer is in contact with the insulation layer.

[Note 14]

The thermal print head according to note 13, wherein the wiring layer comprises a common wire and a plurality of independent wires. The common wire is located on one side in the secondary scan direction relative to the plurality of heating portions and the plurality of independent wires are located on the other side in the secondary scan direction relative to the plurality of heating portions. A portion of the common wire is formed on the inclined surface located on one side of the pair of inclined surfaces in the secondary scan direction. A portion of each of the plurality of independent wires is formed on the inclined surface located on the other side of the pair of inclined surfaces in the secondary scan direction.

[Note 15]

The thermal print head according to note 13 or 14, further comprising a protection layer covering the insulation layer, the plurality of heating portions and the wiring layer.

[Note 16]

The thermal print head according to any one of notes 1 to 15, further comprising a heat dissipation plate, wherein the substrate has a back surface facing a side opposite to the main surface in the thickness direction, and the back surface is joined to the heat dissipation plate.

[Note 17]

A thermal printer, comprising:

the thermal print head according to any one of notes 1 to 16; and a pressure roller, arranged oppositely to the plurality of heating portions.

[Note 18]

A manufacturing method of a thermal print head, being characterized in comprising steps of:

forming a main surface facing a thickness direction, and a protruding surface connected to the main surface and protruding toward one side which the main surface faces in the thickness direction on a base material;

forming a resistance layer on the main surface and the protruding surface, the resistance layer comprising a plurality of heating portions arranged in a main scan direction; and forming a wiring layer in contact with the resistance layer and conductive to the plurality of heating portions;

wherein the protruding surface comprises a top surface parallel to the main surface, and a pair of inclined surfaces connected to the top surface and the main surface and arranged apart from each other in a secondary scan direction;

the manufacturing method further comprises forming a glaze layer in contact with the top surface between the forming of the main surface and the protruding surface and the forming of the resistance layer; and in the forming of the glaze layer, after providing a glaze material in a fluid to the top surface, the glaze material is sintered to form the glaze layer.

[Note 19]

The manufacturing method of the thermal print head according to note 18, wherein the glaze material comprises glass.

[Note 20]

The manufacturing method of the thermal print head according to note 18 or 19, wherein the base material comprises a semiconductor material, and the semiconductor material comprises a monocrystalline material including silicon.

[Note 21]

The manufacturing method of the thermal print head of note 20, wherein in the step of forming the main surface and the protruding surface, the main surface and the protruding surface are formed by means of anisotropic etching.

The invention claimed is:

1. A thermal print head, comprising:

a substrate, having a main surface facing a thickness direction, and a protruding surface connected to the main surface and protruding toward one side which the main surface faces in the thickness direction;

a resistance layer, including a plurality of heating portions arranged in a main scan direction, and formed on the main surface and the protruding surface; and a wiring layer, formed in contact with the resistance layer, and conductive to the plurality of heating portions, wherein the protruding surface includes a top surface parallel to the main surface, and a pair of inclined surfaces connected to the top surface and the main surface and arranged apart from each other in a secondary scan direction;

the thermal print head further includes a glaze layer having a pair of end edges arranged apart from each other in the secondary scan direction and formed in contact with the top surface;

the plurality of heating portions are formed on the glaze layer; and when observed in the thickness direction, each of the pair of end edges includes a receding section located on the top surface, wherein the receding section is formed by the glaze layer receding to an inner side of the top surface from a junction of the top surface and the pair of inclined surfaces.

2. The thermal print head according to claim 1, wherein the protruding surface extends along the main scan direction, and the glaze layer protrudes toward one side which the top surface faces in the thickness direction.

3. The thermal print head according to claim 2, wherein a peripheral edge of the glaze layer is curved at a cross section along the thickness direction and the secondary scan direction.

4. The thermal print head according to claim 3, wherein a size of the glaze layer in the thickness direction is greatest at a center of the glaze layer in the secondary scan direction.

5. The thermal print head according to claim 4, wherein in the secondary scan direction, the plurality of heating portions are located at the center of the glaze layer in the secondary scan direction.

6. The thermal print head according to claim 4, wherein at the cross section, the peripheral edge of the glaze layer includes an edge end portion connected to any of the pair of end edges, the edge end portion has a curved line that is convex toward one side facing the top surface face in the thickness direction; and at the cross section, an inclined angle of a tangent line of the edge end portion passing through the end edges relative to the top surface is less than an inclined angle of each of the pair of inclined surfaces relative to the main surface.

7. The thermal print head according to claim 1, wherein the glaze layer includes a glass-containing material.

8. The thermal print head according to claim 1, wherein the pair of inclined surfaces are inclined in a manner of approaching each other from the main surface to the top surface.

9. The thermal print head according to claim 8, wherein each of the pair of inclined surfaces includes a first region connected to the main surface, and a second region connected to the top surface and the first region, and wherein an inclined angle of the second region relative to the main surface is less than an inclined angle of the first region relative to the main surface.

10. The thermal print head according to claim 1, wherein the substrate comprises a semiconductor material, and the semiconductor material comprises a monocrystalline material including silicon.

11. The thermal print head of claim 1, further comprising an insulation layer covering the main surface, the pair of inclined surfaces and the glaze layer, wherein the resistance layer is in contact with the insulation layer.

12. The thermal print head according to claim 11, wherein the wiring layer includes:

a common wire, located on one side in the secondary scan direction relative to the plurality of heating portions; and a plurality of independent wires, located on the other side in the secondary scan direction relative to the plurality of heating portions, and wherein a portion of the common wire is formed on the inclined surface located on one side of the pair of inclined surfaces in the secondary scan direction, and a portion of each of the plurality of independent wires is formed on the inclined surface located on the other side of the pair of inclined surfaces in the secondary scan direction.

13. The thermal print head of claim 11, further comprising a protection layer covering the insulation layer, the plurality of heating portions and the wiring layer.

14. A thermal printer, comprising:

the thermal print head of claim 1; and a pressure roller, arranged oppositely to the plurality of heating portions.

15. A manufacturing method of a thermal print head, comprising:

forming a main surface facing a thickness direction, and a protruding surface connected to the main surface and protruding toward one side which the main surface faces in the thickness direction on a base material;

forming a resistance layer on the main surface and the protruding surface, the resistance layer including a plurality of heating portions arranged in a main scan direction; and forming a wiring layer in contact with the resistance layer and conductive to the plurality of heating portions, wherein the protruding surface includes a top surface parallel to the main surface, and a pair of inclined surfaces connected to the top surface and the main surface and arranged apart from each other in a secondary scan direction, wherein the manufacturing method further comprises forming a glaze layer in contact with the top surface between the forming of the main surface and the protruding surface and the forming of the resistance layer, wherein in the forming of the glaze layer, after providing a glaze material in a fluid to the top surface, the glaze material is sintered to form the glaze layer, and wherein the sintering of the glaze material contracts the glaze material in a manner that an end edge of the glaze layer recedes to an inner side of the top surface from a junction of the top surface and the pair of inclined surfaces.

* * * * *